US011352852B2

(12) United States Patent
Macek et al.

(10) Patent No.: US 11,352,852 B2
(45) Date of Patent: Jun. 7, 2022

(54) SHIFTABLE COVERS, COMPLETION SYSTEMS, AND METHODS TO SHIFT A DOWNHOLE COVER IN TWO DIRECTIONS

(71) Applicant: Halliburton Energy Services, Inc., Houston, TX (US)

(72) Inventors: Mark D. Macek, Tyler, TX (US); Christopher R. Delzell, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/945,380

(22) Filed: Jul. 31, 2020

(65) Prior Publication Data

US 2022/0034195 A1 Feb. 3, 2022

(51) Int. Cl.
*E21B 34/14* (2006.01)

(52) U.S. Cl.
CPC ..... *E21B 34/14* (2013.01)

(58) Field of Classification Search
CPC ..... E21B 34/14
See application file for complete search history.

(56) References Cited

U.S. PATENT DOCUMENTS 4,176,717 A 12/1979 Hix
7,021,389 B2 4/2006 Bishop et al.
7,150,326 B2 12/2006 Bishop et al.
2006/0213670 A1 9/2006 Bishop et al.
2015/0101825 A1* 4/2015 Jacob ..... E21B 34/14 166/376
2015/0159469 A1* 6/2015 Purkis ..... E21B 34/106 166/373
2015/0204164 A1 7/2015 Themig et al.
2017/0122068 A1* 5/2017 Graf ..... E21B 34/14

FOREIGN PATENT DOCUMENTS

CN 104790909 B 6/2018
WO 2018148159 A1 8/2018

OTHER PUBLICATIONS

International Search Report & Written Opinion in PCT Appln No. PCT/US2020/045049, dated Apr. 22, 2021.

* cited by examiner

*Primary Examiner* — Dany E Akakpo
(74) *Attorney, Agent, or Firm* — McGuireWoods LLP

(57) ABSTRACT

The disclosed embodiments include shiftable covers, completion systems, and methods to shift a downhole cover in two directions. A shiftable cover includes a hollow interior configured to receive a diverter flowing in a first direction. The shiftable cover also includes a diverter seat disposed in the hollow interior and configured to retain the diverter. The shiftable cover also includes a plurality of segments configured to collapse in response to shifting of the shiftable cover from a first position to a second position to retain the diverter, and un-collapse in response to shifting of the shiftable cover from the second position towards the first position.

20 Claims, 21 Drawing Sheets

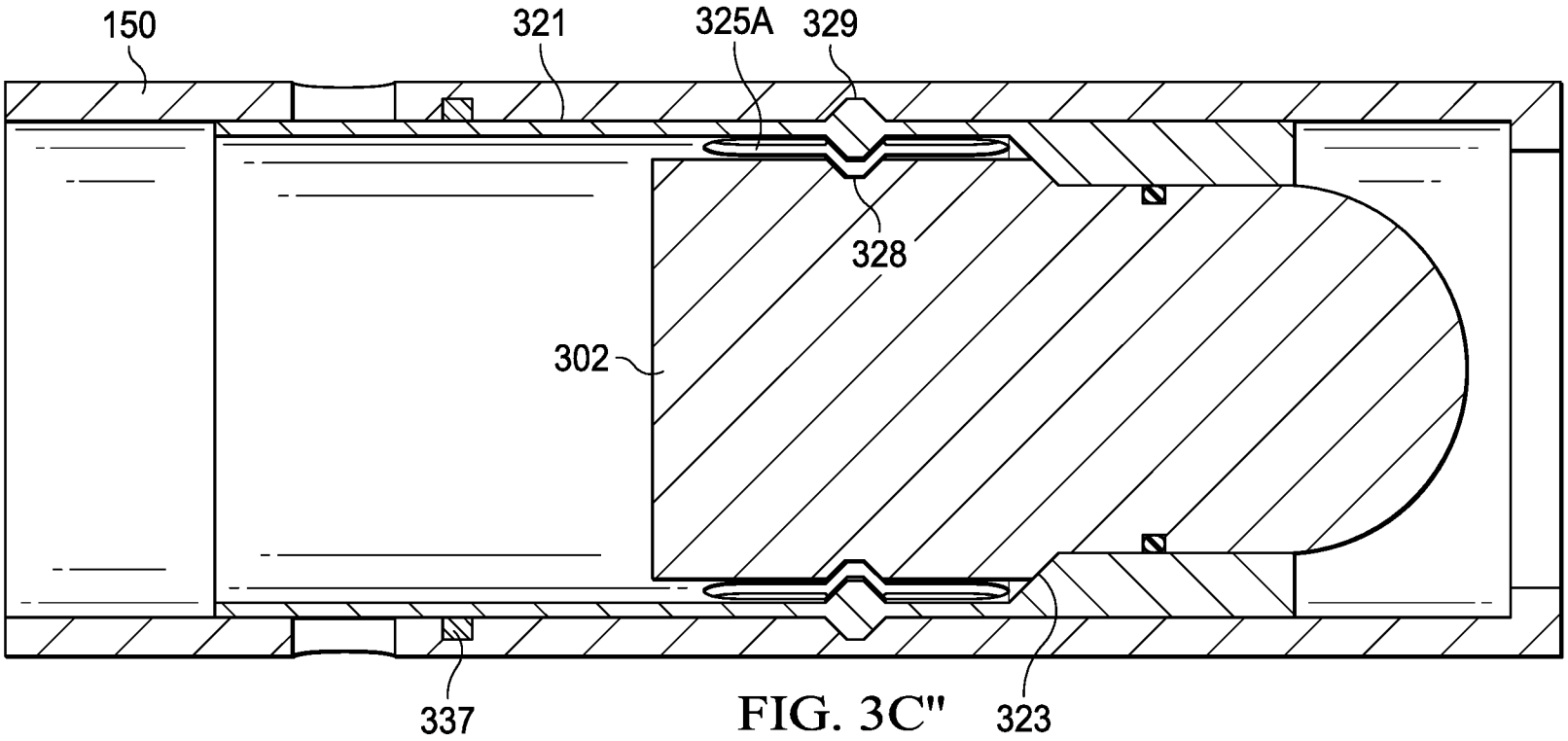
FIG. 3C"

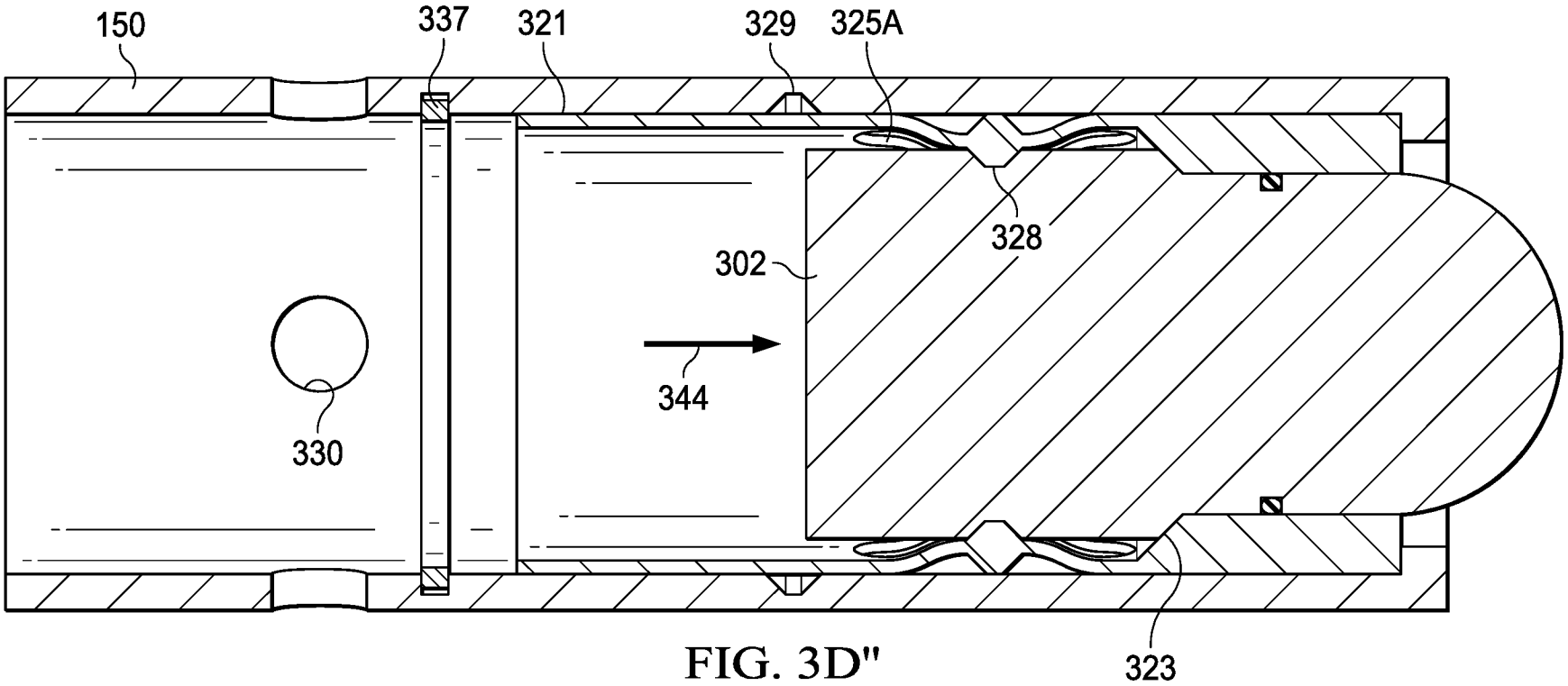
FIG. 3D"

SHIFTABLE COVERS, COMPLETION SYSTEMS, AND METHODS TO SHIFT A DOWNHOLE COVER IN TWO DIRECTIONS

BACKGROUND

The present disclosure relates generally to shiftable covers, completion systems, and methods to shift a downhole cover in two directions.

A port, such as a fracture port, is sometimes disposed in a wall of a downhole tubular that extends from surface into a wellbore of a hydrocarbon well. The port sometimes provides fluid communication between a flowbore of the tubular and an annular region between the tubular and the wellbore. In some embodiments, the port is initially covered by a sleeve that is shiftable from an initial position covering the port to a second position before commencement of a well operation through the port.

BRIEF DESCRIPTION OF THE DRAWINGS

Illustrative embodiments of the present disclosure are described in detail below with reference to the attached drawing figures, which are incorporated by reference herein, and wherein:

FIG. 3C' is a schematic, partial cross-sectional view of an alternative embodiment of the completion system illustrated in FIG. 3C where a retaining member is disposed in the tubular and is held in a contracted position by the cover while the cover is in a first position;

FIG. 3C" is a schematic, partial cross sectional view of a second alternative embodiment of the completion system illustrated in FIG. 3C where a retaining member is disposed in the tubular and is held in a contracted position by the cover while the cover is in a first position;

FIG. 3C'" is a schematic, partial cross sectional view of a third alternative embodiment of the completion system illustrated in FIG. 3C where the tubular has a second recess formed circumferentially along a wall of the flowbore;

FIG. 3D' is a schematic, partial cross-sectional view of an alternative embodiment of the completion system illustrated in FIG. 3D where the retaining member shifts to an expanded position after the cover of FIG. 3C' shifts from the first position illustrated in FIG. 3C' to a second position illustrated in FIG. 3D';

FIG. 3D" is a schematic, partial cross-sectional view of a second alternative embodiment of the completion system illustrated in FIG. 3D where the retaining member shifts to an expanded position after the cover of FIG. 3C" shifts from the first position illustrated in FIG. 3C" to a second position illustrated in FIG. 3D";

Figure 3A:
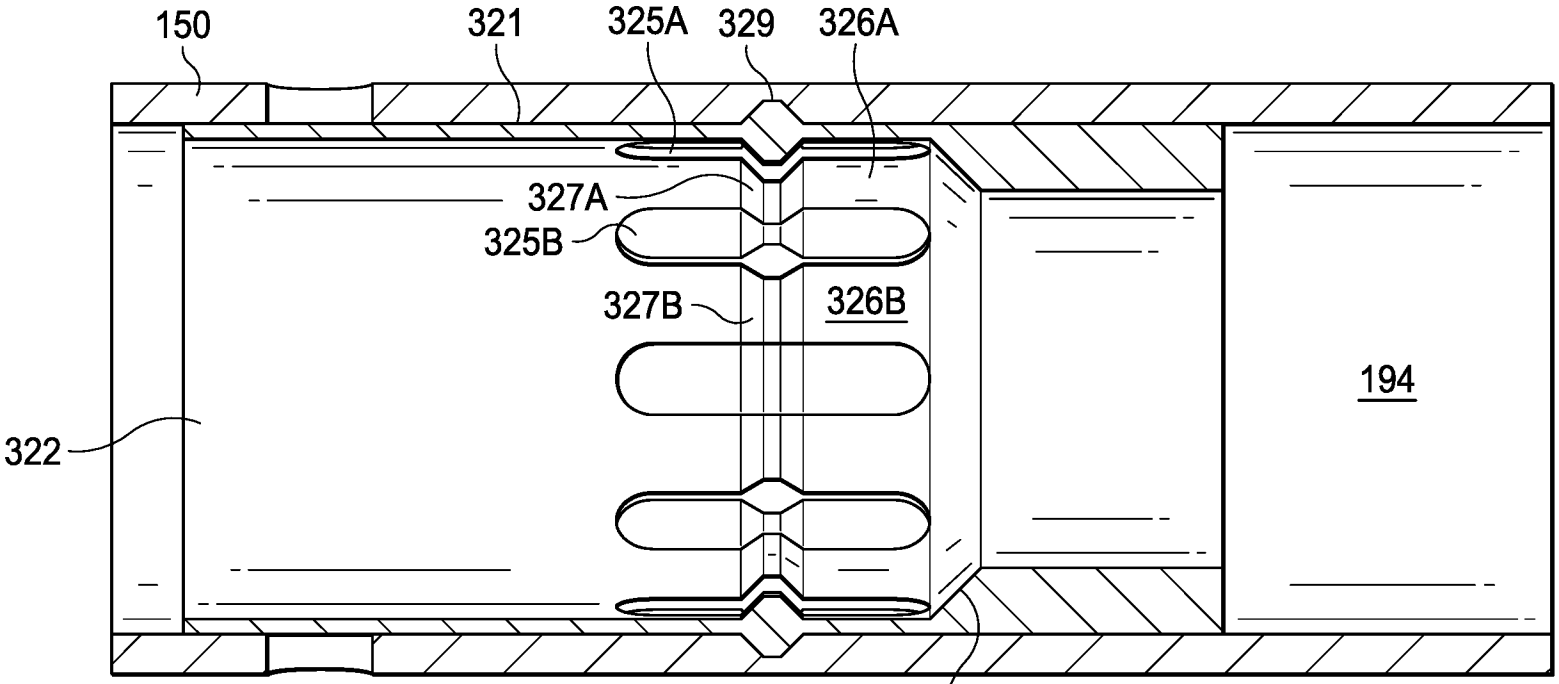
FIG. 3A is a schematic, partial cross-sectional view of another cover disposed in a tubular of the completion system of FIG. 1.
Figure 3B:
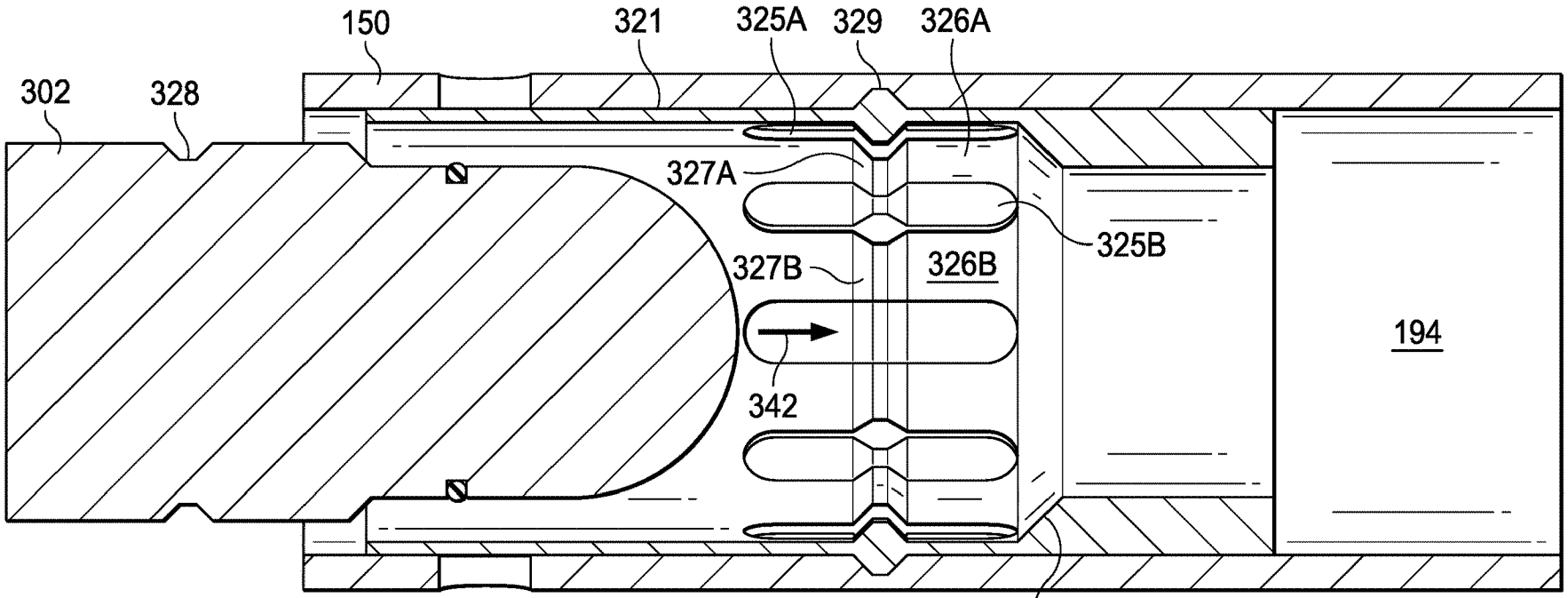
FIG. 3B is a schematic, partial cross-sectional view of the cover of FIG. 3A after a diverter flows into the tubular.
Figure 3C:
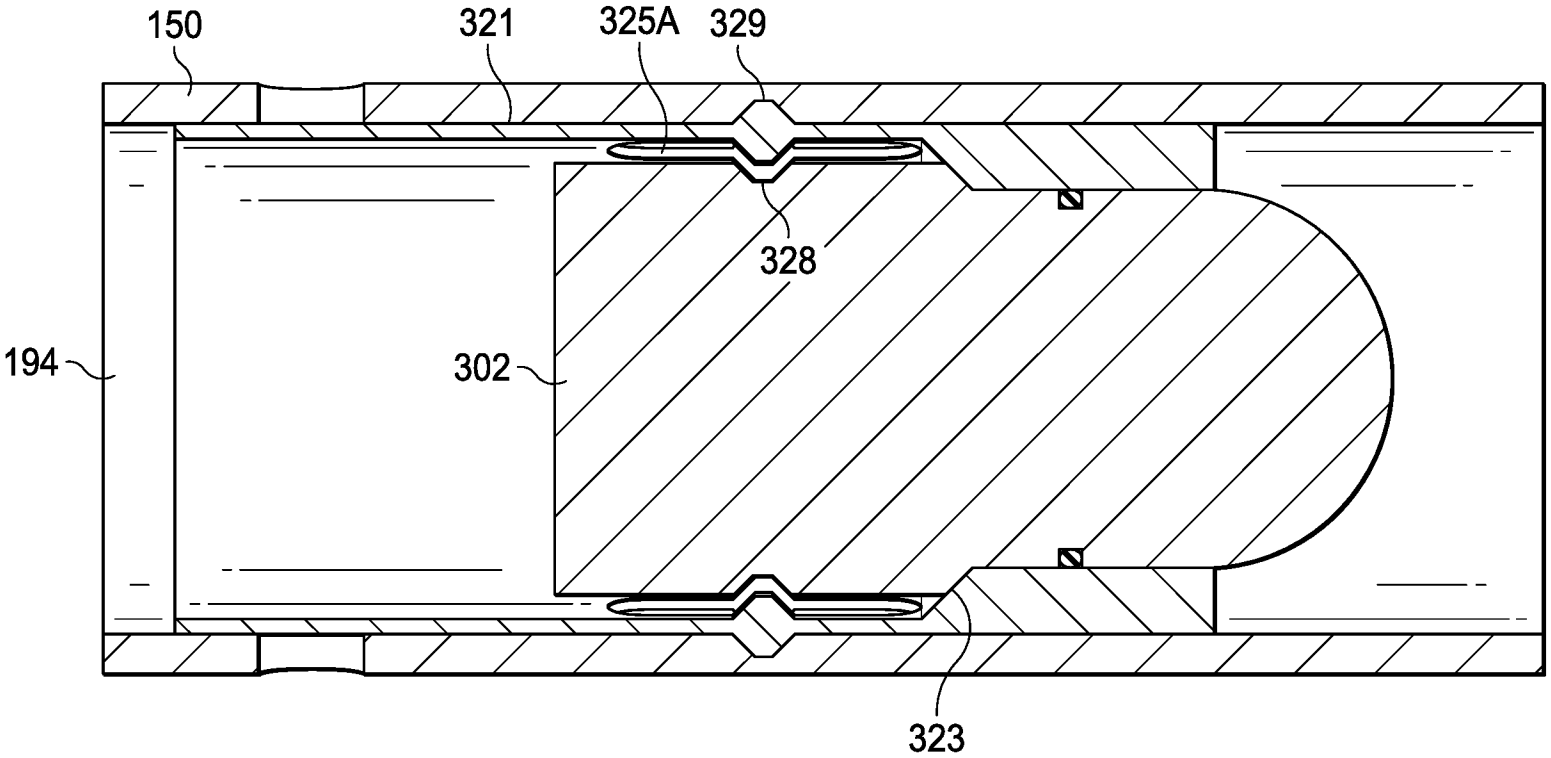
FIG. 3C is a schematic, partial cross-sectional view of the cover of FIG. 3B, where profiles of the diverter are aligned with profiles of the cover of FIG. 3B.
Figure 3C:
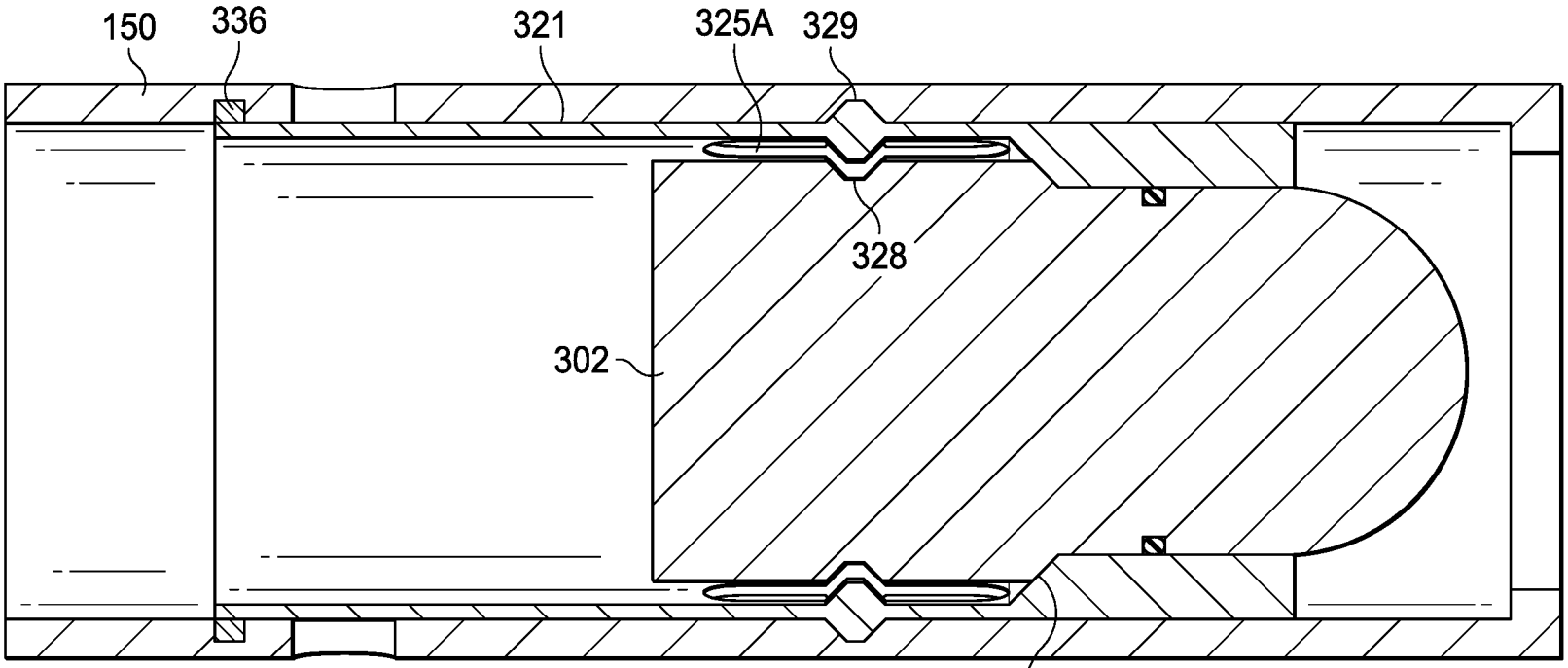
Figure 3C:
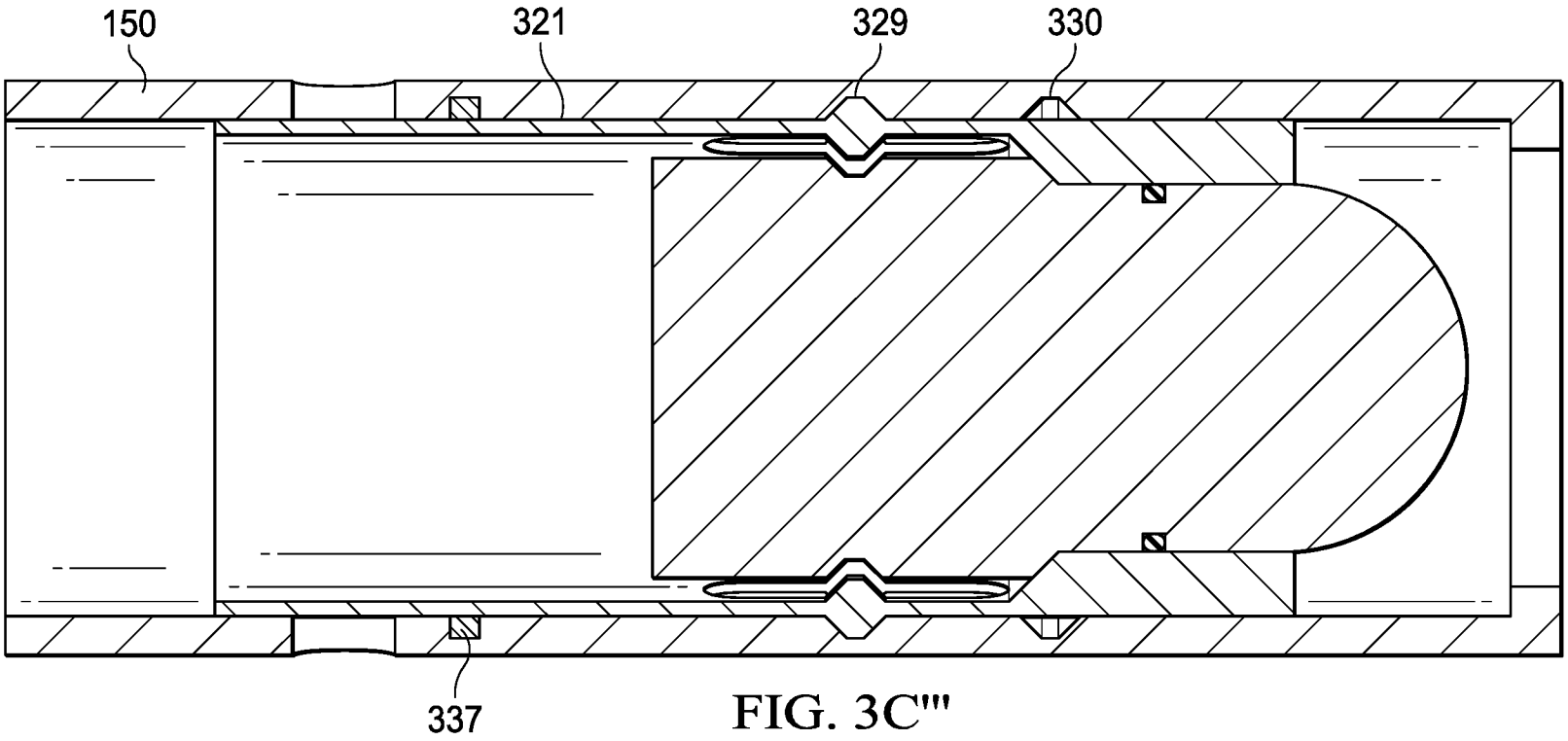
Figure 3D:
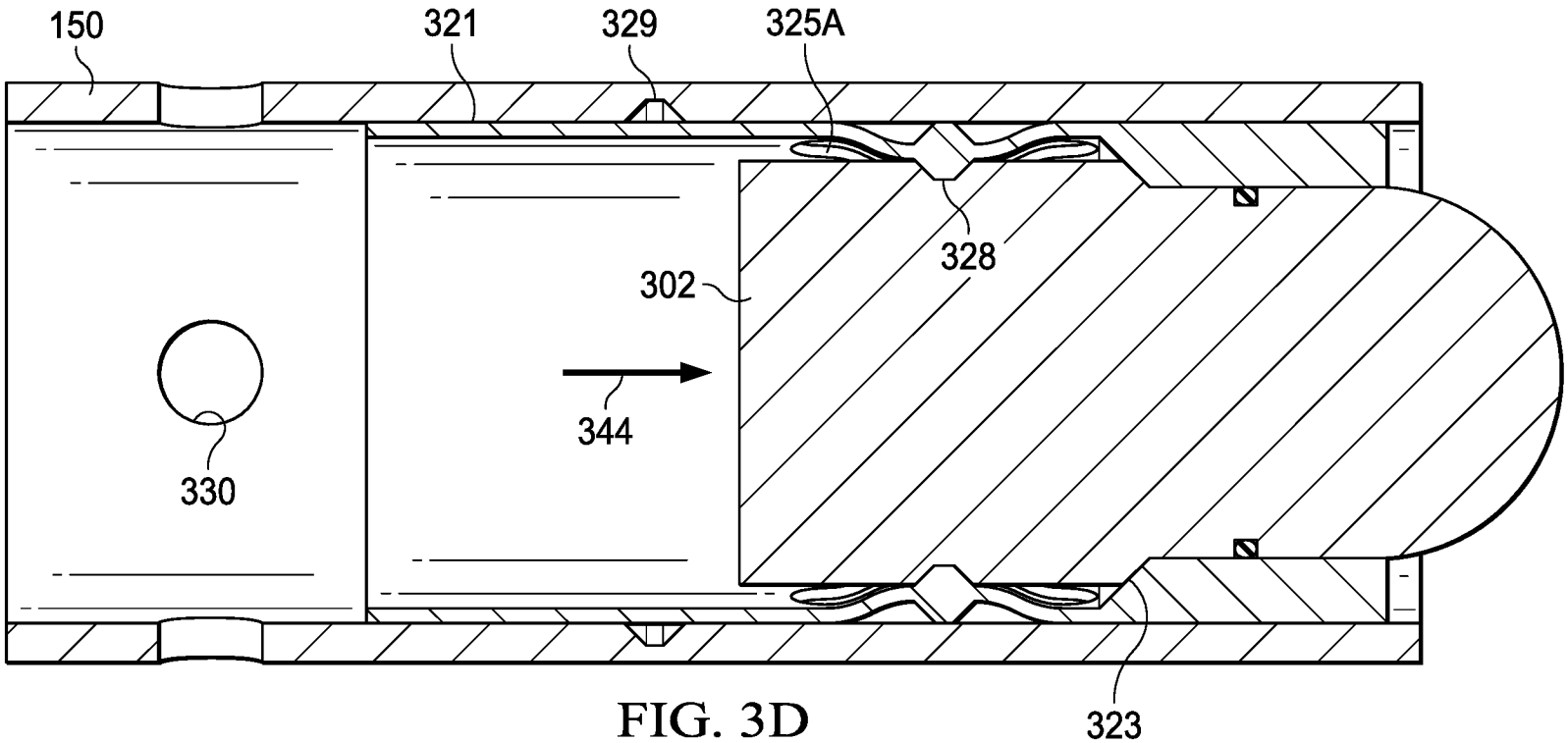
FIG. 3D is a schematic, cross-sectional view of the cover of FIG. 3C after pressure is applied in a first direction to shift the cover from the first position illustrated in FIG. 3C to a second position illustrated in FIG. 3D.
Figure 3D:
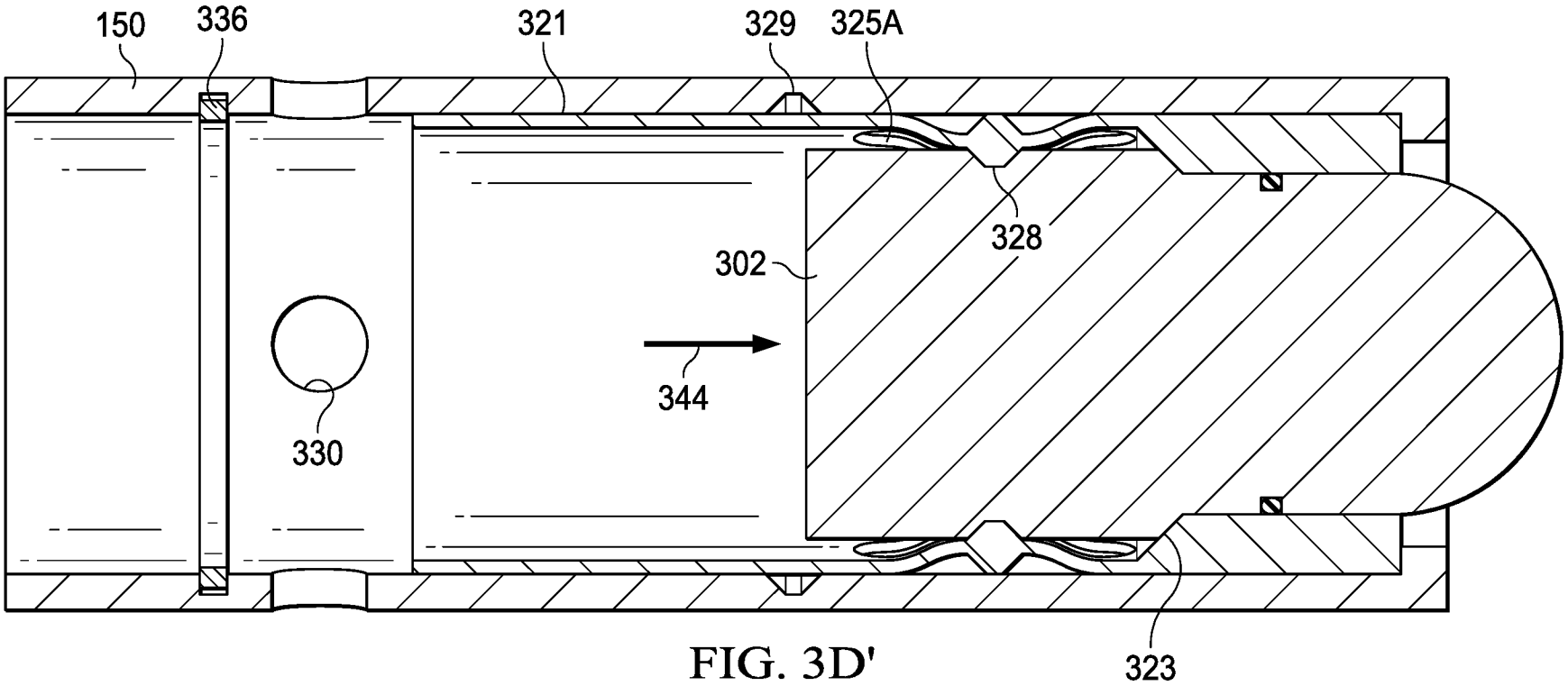
Figure 3D:
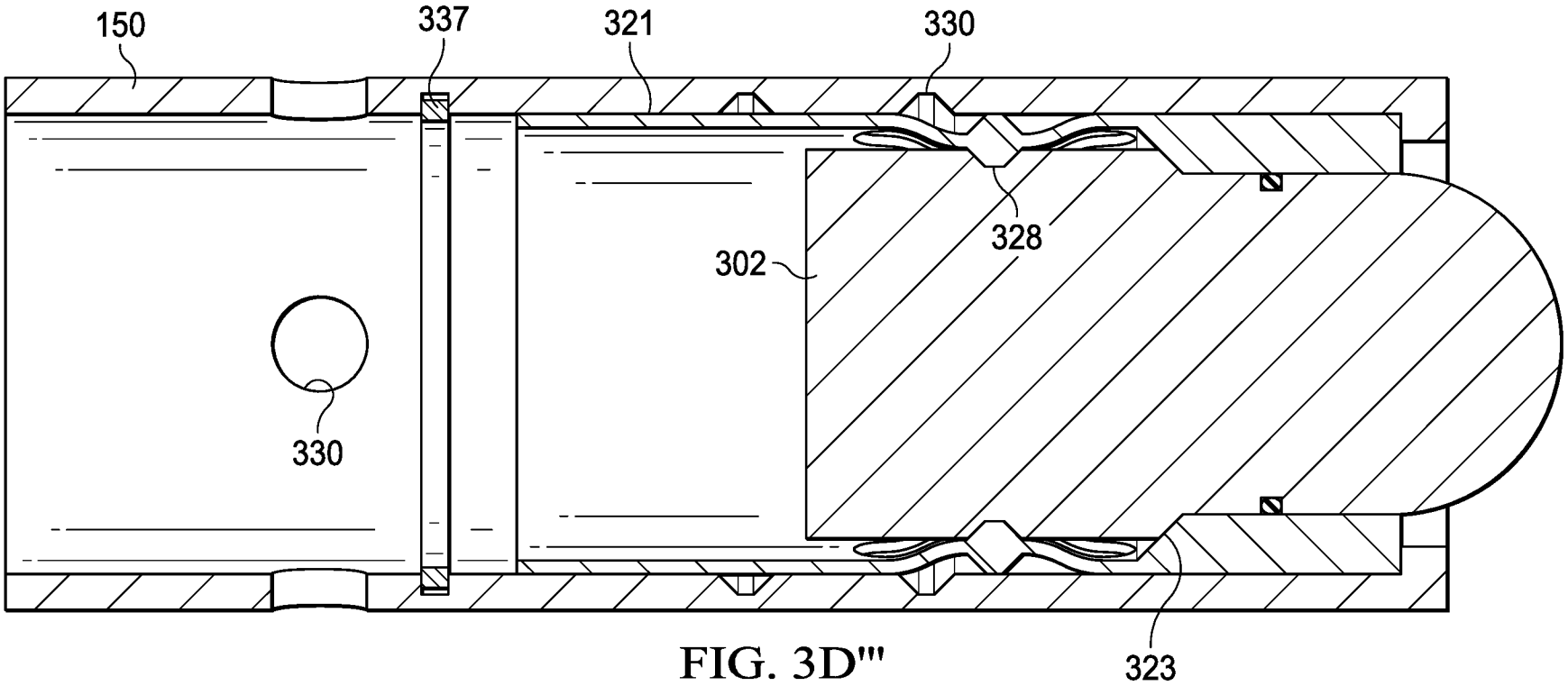

3D'" is a schematic, partial cross-sectional view of a third alternative embodiment of the completion system illustrated in FIG. 3D where the cover of FIG. 3C'" shifts from the first position illustrated in FIG. 3C'" to a second position illustrated in FIG. 3D'" that is further downhole from the second recess.

Figure 3E:
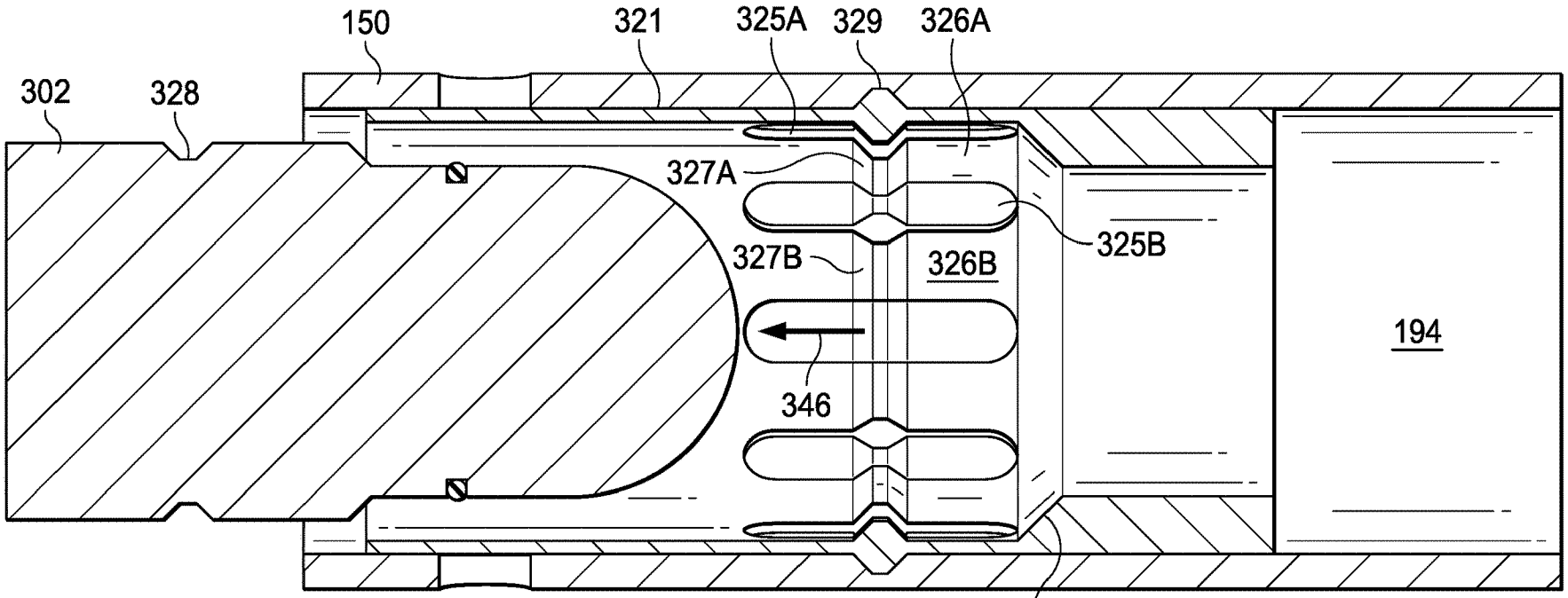
Figure 3E:
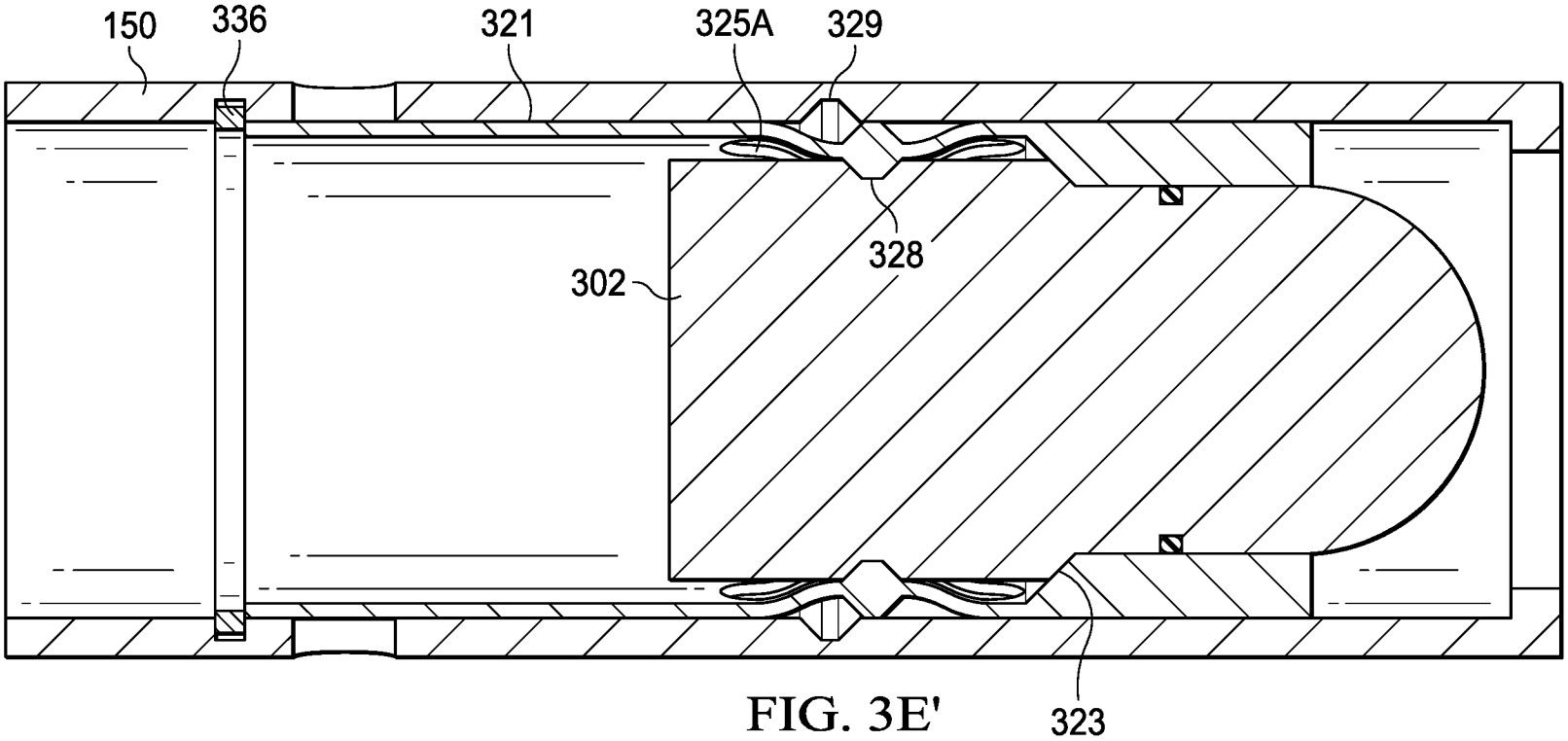
Figure 3E:
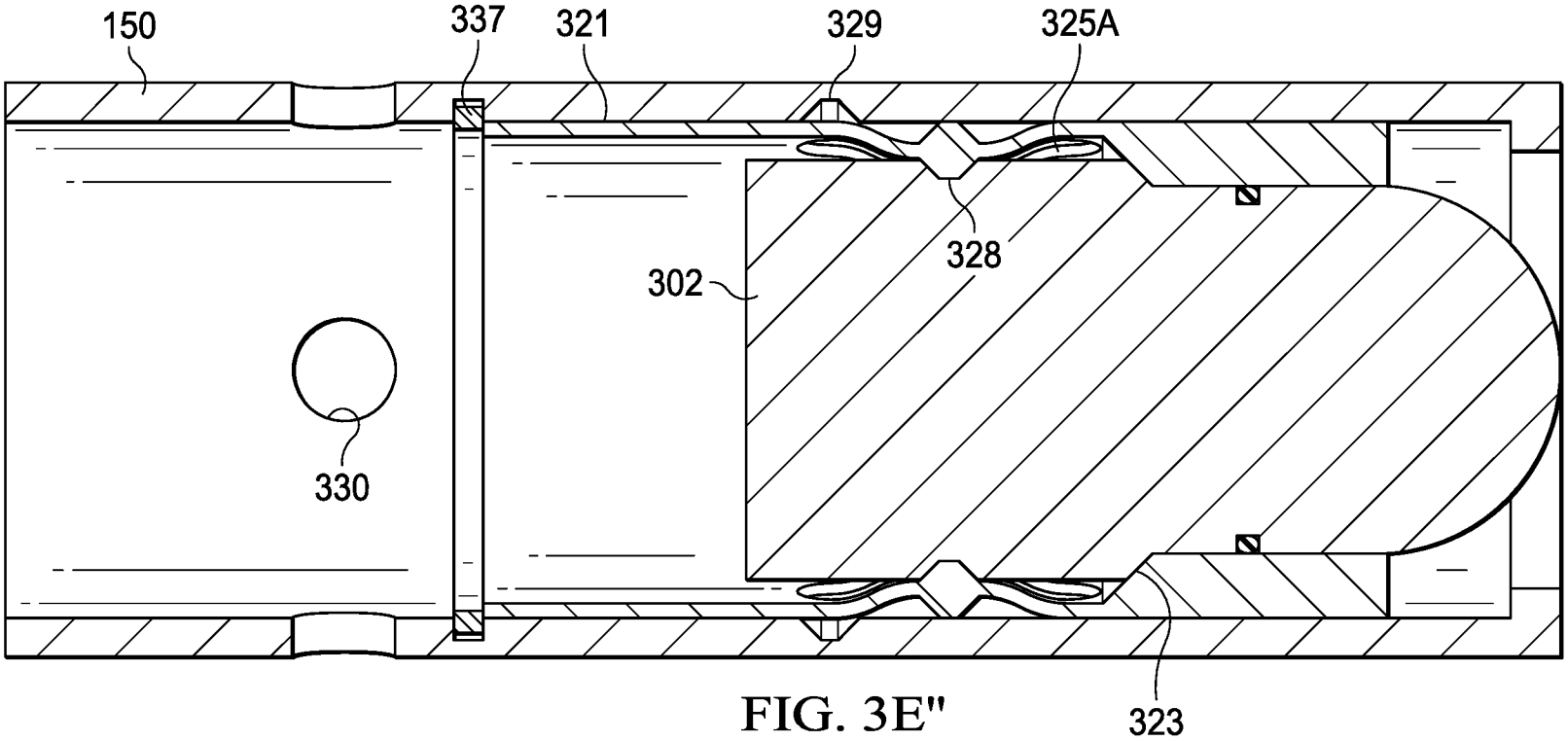
Figure 3E:
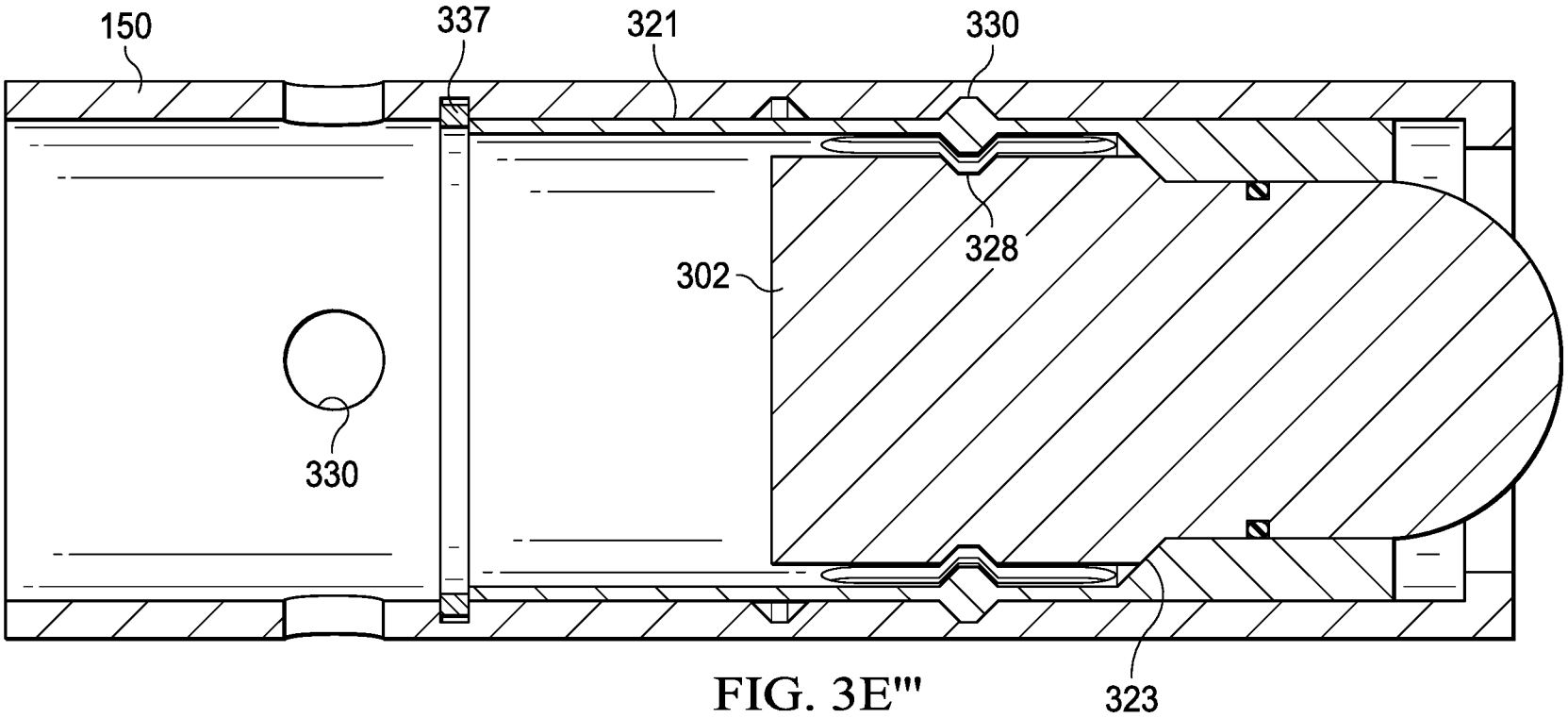
Figure 4:
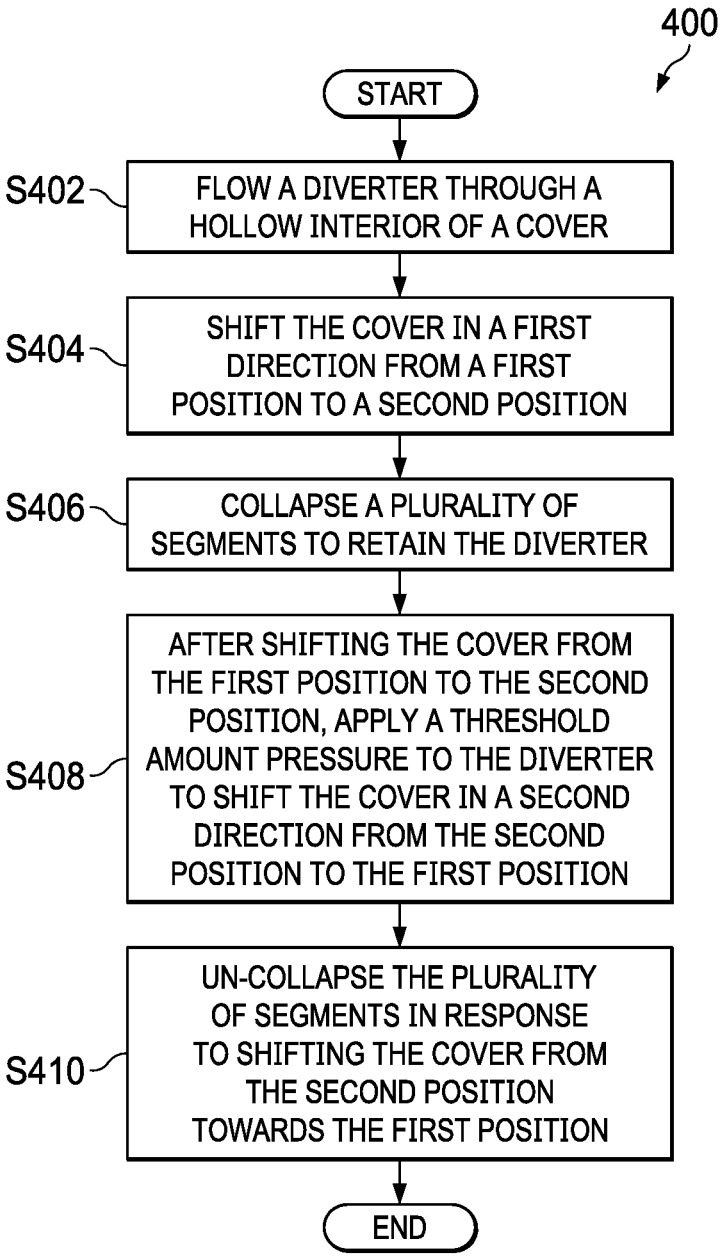

FIG. 3E illustrates a schematic cross-sectional view of the cover of FIG. 3D after a threshold account of pressure is applied in a second direction to shift the cover from the second position to the first position;

FIG. 3E' is a schematic, partial cross-sectional view of an alternative embodiment of the completion system illustrated in FIG. 3E where the retaining member prevents the cover from shifting from the second position illustrated in FIG. 3D' to the first position illustrated in FIG. 3C';

FIG. 3E" is a schematic, partial cross-sectional view of a second alternative embodiment of the completion system illustrated in FIG. 3E where the retaining member prevents the cover from shifting from the position illustrated in FIG. 3D" to the first position illustrated in FIG. 3C";

FIG. 3E'" is a schematic, partial cross-sectional view of a third alternative embodiment of the completion system illustrated in FIG. 3E where the cover shifts from the second position illustrated in FIG. 3D'" to a third position illustrated in FIG. 3E'"; and FIG. 4 is a flow chart of a process to shift a downhole cover in two directions.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to shiftable covers, completion systems that utilize shiftable covers, and methods to shift a downhole cover in two directions. As referred to herein, a cover is any device or component configured to prevent or restrict fluid communication through a port or an opening. In some embodiments, a cover is shiftable from a first position, which prevents fluid communication through the port, to a second position to allow fluid communication through the port. In some embodiments, the cover is a sleeve that is configured to prevent fluid communication through the port while in one position, and is configured to allow fluid communication through the port while in a second position. A cover includes a hollow interior and a diverter seat that is formed in or is disposed in the hollow interior. In some embodiments, the hollow interior connects two openings, and has a tapered profile that allows a diverter flowing in a direction (such as in a downhole direction) to flow into one opening and prevents the diverter from flowing out of the second opening. As referred to herein, a diverter seat is any device configured to catch or retain a diverter, whereas a diverter is any device configured to engage the diverter seat to shift the cover. Examples of diverter seats include, but are not limited to, ball seats, dart seats, and plug seats, whereas examples of diverters include, but are not limited to, balls, darts, and plugs that are deployable in the flowbore. In some embodiments, the diverter seat is formed by a tapered profile of the hollow interior, which allows the diverter to flow into one opening of the cover, but prevents the diverter from flowing out of a second opening of the cover.

The cover may include multiple slits and segments that are positioned circumferentially around the cover. In some embodiments, each segment is positioned in between two adjacent slits. In some embodiments, the segments have tapered profiles, such as profiles that engage corresponding profiles or recesses of the tubular or the diverter. As the cover shifts, such as from the first position to the second position to uncover the port, the segments collapse inwardly towards a central axis. The collapsed segments reduce the circumference of the hollow interior, thereby retaining the diverter in the hollow interior and (together with the diverter seat) preventing the diverter from flowing out of the cover. In some embodiments, the segments form a collapsible collet that clamps inwardly while the segments are in a collapsed position. In some embodiments, the segments form a temporary diverter seat.

The segments remain collapsed until pressure is applied to the cover and/or the diverter to shift the cover, such as from the second position to the first position to cover the port. In some embodiments, the segments un-collapse only after a threshold amount of pressure is applied to the cover and/or the diverter to avoid prematurely releasing the diverter. As the cover shifts towards the first position, the segments un-collapse, releasing the diverter to flow out of the hollow interior, such as in an uphole direction into the tubular, and some embodiments, towards the surface or another location uphole from the cover. In some embodiments, one or more sealing elements are positioned along or formed on the outer diameter of the cover to form a fluid seal around the outer diameter of the cover. Similarly, in some embodiments, one or more sealing elements are positioned along or formed on a surface of the diverter seat to fluidly seal the interior of the cover after a diverter lands on the diverter seat. Additional descriptions of covers, downhole completion systems, and methods to shift covers in different directions are provided in the paragraphs below and are illustrated in FIGS. 1-4.

Figure 1:
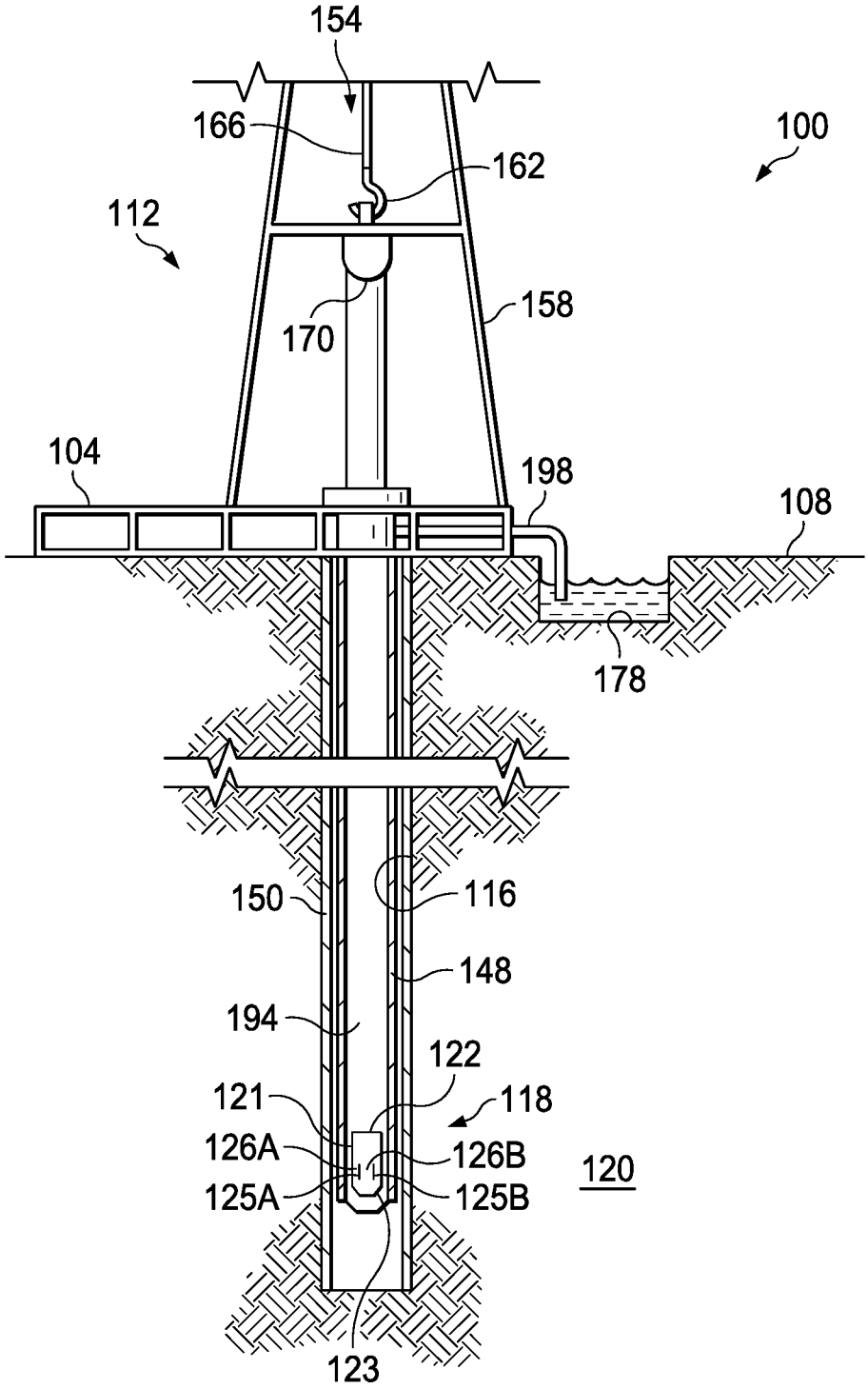
FIG. 1 is a schematic, side view of a completion environment where a completion system is deployed in a wellbore.

FIG. 1 is a schematic, side view of a completion environment 100 where a completion system having a cover is deployed in a wellbore 116 of a well 112. As shown in FIG. 1, wellbore 116 extends from surface 108 of well 112 to a subterranean substrate or formation 120. Well 112 and rig 104 are illustrated onshore in FIG. 1. Alternatively, the operations described herein and illustrated in the figures are performed in an off-shore environment.

In the embodiment illustrated in FIG. 1, wellbore 116 has been formed by a drilling process in which dirt, rock and other subterranean materials are removed to create wellbore 116. In some embodiments, a portion of wellbore 116 is cased with a casing (not illustrated). In other embodiments, wellbore 116 is maintained in an open-hole configuration without casing. The embodiments described herein are applicable to either cased or open-hole configurations of wellbore 116, or a combination of cased and open-hole configurations in a particular wellbore.

After drilling of wellbore 116 is complete and the associated drill bit and drill string are "tripped" from wellbore 116, a tubular, such as tubular 150, is lowered into wellbore 116. As referred to herein, a tubular may be a coiled tubing, a drill pipe, a production tubing, or another type of conveyance that has an inner diameter that forms a flowbore for fluids and solid particles and components (e.g., diverters) to pass through. In the embodiment of FIG. 1, tubular 150 is lowered by a lift assembly 154 associated with a derrick 158 positioned on or adjacent to rig 104 as shown in FIG. 1. Lift assembly 154 includes a hook 162, a cable 166, a traveling block (not shown), and a hoist (not shown) that cooperatively work together to lift or lower a swivel 170 that is coupled to an upper end of tubular 150. In some embodiments, tubular 150 is raised or lowered as needed to add additional sections of tubing to tubular 150 to position cover 121 at a desired depth or zone in wellbore 116.

In the embodiment of FIG. 1, a completion system 118 having tubular 150 and cover 121 is deployed in wellbore 116. Tubular 150 includes a flowbore 194 through which a diverter (such as the diverters illustrated in FIGS. 2B and 3B) travels through downhole. As referred to herein, downhole refers to a direction along tubular 150 that is away from the surface end of tubular 150, whereas uphole refers to a direction along tubular 150 that is towards the surface end of tubular 150. In some embodiments, tubular 150 provides a fluid flow path for fluids to flow into an annulus 148 exterior of cover 121, and from annulus 148 into one or more cross-over ports (not shown) that provide fluid flow around (such as uphole and/or downhole from) cover 121, where the fluid eventually flows uphole into an outlet conduit 198, and from outlet conduit 198 into a container 178. In one or more of such embodiments, pressure is exerted through a cross-over port to shift cover 121 (such as to shift cover 121 uphole), reverse out a diverter from cover 121, and/or to perform other well operations. In some embodiments, one or more pumps (not shown) are utilized to facilitate fluid flow downhole or uphole, and to generate pressure downhole or uphole. A port, (such as a fracture port, a production port, or another type of port) that is configured to provide fluid communication between flowbore 194 and annulus 148 is disposed in a wall of tubular 150. In some embodiments, the port has one or more of geometries and/or orientations, including but not limited to, round, oval, square, angled, or a combination of geometries and/or orientations that permits fluid communication. In the embodiment of FIG. 1, the port is initially covered by cover 121.

Cover 121 has an opening 122 to a hollow interior configured to receive a diverter flowing downhole through flowbore 194 of tubular 150. Cover 121 also has a diverter seat 123 that is disposed in or formed by the hollow interior. Diverter seat 123 provides a landing for a diverter, and also prevents the diverter from traveling further downhole. Cover 121 also includes slits 125A and 125B formed along cover and positioned circumferentially around cover 121. Further, cover 121 also includes segments 126A and 126B formed in between adjacent slits and also positioned circumferentially around cover 121. Additional descriptions of cover 121 and components of cover 121 are provided in the paragraphs below. Further, zoomed-in views of different embodiments of cover 121 and similar covers are illustrated in at least FIGS. 2A-3E.

In the embodiment of FIG. 1, cover 121 is in a first position that covers one or more ports. In some embodiments, where one of the one or more ports provides fluid communication from flowbore 194 to annulus 148, cover 121 restricts fluid communication through the port while cover 121 is in the first position. In some embodiments, where the port is a fracture port, cover 121 remains in the first position illustrated in FIG. 1 before commencement of a fracturing operation. A diverter, such as a ball, is dropped downhole through flowbore 194 of tubular 150 into opening 122, and lands on diverter seat 123. In some embodiments, force generated by the diverter landing on diverter seat 123 shifts cover 121 to a second position such as the position illustrated in FIGS. 2C and 3D. In some embodiments, additional pressure is applied through flowbore 194 to the diverter and/or cover 121 to shift cover 121 from the first position to the second position. The shifting of cover 121 from the first position to the second position also collapses segments 126A and 126B inwardly towards a central axis. The collapsed segments reduce the circumference of the interior of cover 121, thereby preventing the diverter from flowing out of opening 122 while cover 121 remains in the second position. In some embodiments, the collapsed segments form a temporary diverter seat that prevents further uphole movement of diverter while cover 121 remains in the second position. In some embodiments, after well operations are performed through the port, a threshold amount of pressure is applied to cover 121 and/or directly to the diverter to shift cover 121 back to the first position illustrated in FIG. 1. As cover 121 shifts towards the first position, segments 126A and 126B return to their original states, thereby allowing the diverter to travel back uphole.

In some embodiments, completion system 118 also includes a retaining member, such as a retaining member illustrated in FIGS. 3C'-3D'. In one or more of such embodiments, the retaining member is initially held in a contracted position by cover 121 while cover 121 is in the position illustrated in FIG. 1. In one or more of such embodiments, the retaining member is activated, expands, or shifts to an expanded position after cover 121 shifts to a second position to uncover the port to restrict movement of the diverter and cover 121. In one or more of such embodiments, the retaining member has a shearable piece that is engineered to shear if a threshold amount of pressure is applied to the retaining member. Additional descriptions of the engagement piece are provided in paragraphs below.

Although FIG. 1 illustrates a substantially vertical wellbore 116, cover 121 and the completion system described herein are deployable in horizontal wellbores, diagonal wellbores, tortuous shaped wellbores, and other types of wellbores. Further, although FIG. 1 illustrates one cover 121 disposed along flowbore 194 of tubular 150, in some embodiments, multiple covers (not shown) are disposed in flowbore 194 of tubular 150. Further, although FIG. 1 illustrates a completion system deployed in a completion environment, cover 121 is also deployable in other well environments. In that regard, cover 121 is deployable in other types of systems deployed in other types of well environments. Similarly, operations described herein to shift cover 121 and to retain a diverter disposed within cover 121 may be performed during stimulation operations, production operations, as well as other types of well operations. Additional descriptions of cover 121 and similar covers are provided in the paragraphs below and are illustrated in at least FIGS. 2A-3E.

Figure 2A:
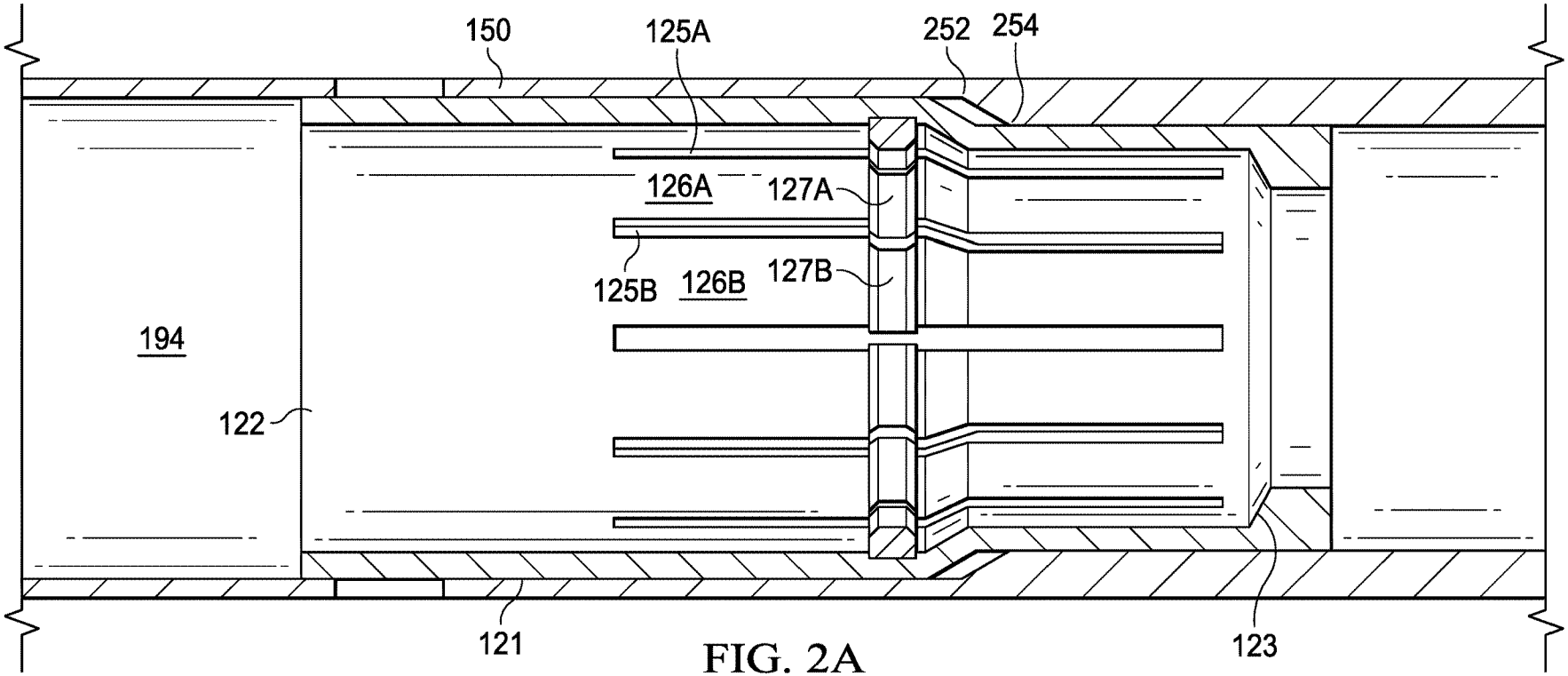
FIG. 2A is a schematic, partial cross-sectional view of a cover disposed in a tubular of the completion system of FIG. 1.

FIG. 2A is a schematic, partial cross-sectional view of cover 121 disposed in tubular 150 of completion system 118 of FIG. 1. In the embodiment of FIG. 2A, flowbore 194 has a tapered profile between locations 252 and 254, where the circumference of flowbore 194 at location 252 is greater than the circumference of flowbore 194 at location 254. Similarly, cover 121 also has a corresponding tapered profile, where the circumference of cover 121 at location 252 is greater than the circumference of cover 121 at location 254. Cover 121 has a hollow interior that is configured to receive a diverter, such as a ball illustrated in FIG. 2B, through an opening 122. Diverter seat 123 is formed from by or is disposed in the hollow interior of cover 121, and is configured to prevent the diverter from flowing further downhole. In the embodiment of FIG. 2A, diverter seat 123 has an opening that allows fluids to flow through diverter seat 123.

Cover 121 has segments, including segments 126A and 126B, each having a tapered profile, and slits, including slits 125A and 125B that are positioned between adjacent segments. In some embodiments, segments 126A and 126B are fingers of a collet that are collapsible to reduce the circumference of the hollow interior, and to restrict movement of the ball after the ball lands on diverter seat 123. It is understood that the number of segments and slits illustrated in FIG. 2A is for illustration purposes, in some embodiments, cover 121 has a different number of segments and a different number of slits circumferentially positioned around cover 121. Segments 126A and 126B have tapered profiles (protrusions 127A and 127B). In some embodiments, protrusions 127A and 127B are inwardly extendable as cover 121 shifts downhole. In some embodiments, protrusions 127A and 127B are electrically triggered (not shown) in response to a determination that cover 121 has shifted. In one or more of such embodiments, protrusions 127A and 127B automatically extend inwardly as segments 126A and 126B collapse in response to cover 121 shifting from the first position illustrated in FIG. 2A to the second position illustrated in FIG. 2C, and automatically retract in response to cover 121 shifting from the second position back to the first position. The number of protrusions in FIG. 2A is for illustration purposes, in some embodiments, a different number of protrusions 127A and 127B are circumferentially positioned around cover 121. Moreover, in some embodiments, some of the protrusions have differently shaped or tapered profiles.

Figure 2B:
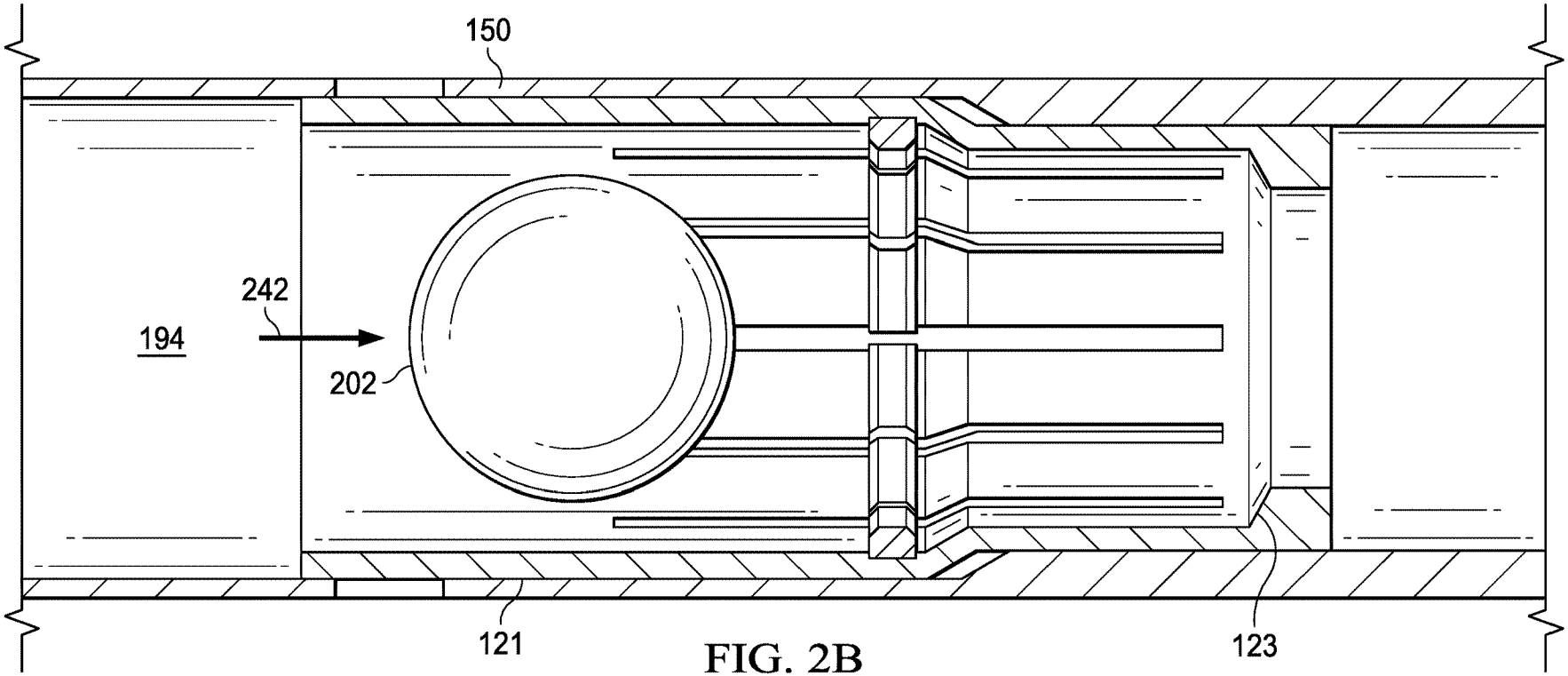
FIG. 2B is a schematic, partial cross-sectional view of the cover of FIG. 2A after a diverter flows into the tubular.

FIG. 2B is a schematic, partial cross-sectional view of cover 121 of FIG. 2A after a diverter flows into tubular 150. In the embodiment of FIG. 2B, a ball 202 flows in a direction illustrated by arrow 242 downhole towards diverter seat 123. In the embodiment of FIG. 2B, force applied by ball 202 on diverter seat 123 when ball 202 lands on diverter seat 123 shifts cover 121 from the position illustrated in FIG. 2B to the position illustrated in FIG. 2C. In some embodiments, additional pressure is applied downhole (to ball 202 and/or cover 121) to shift cover 121 to the position illustrated in FIG. 2C. In one or more of such embodiments, where cover 121 shifts after a threshold amount of pressure is applied to cover 121, pressure is pumped downhole through flowbore 194 to shift cover 121 to the second position.

Figure 2C:
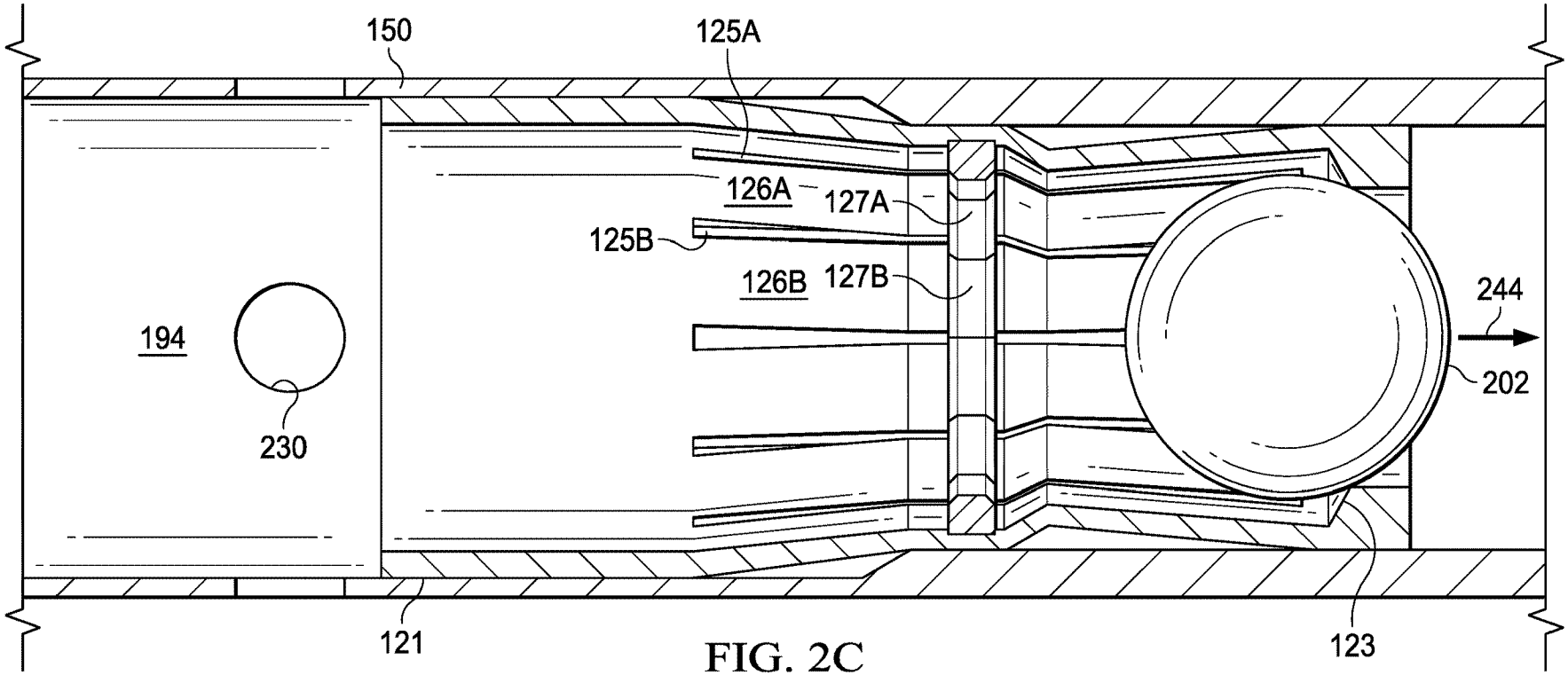
FIG. 2C is a schematic, cross-sectional view of the cover of FIG. 2B after pressure is applied in a first direction to shift the cover from a first position illustrated in FIG. 2B to a second position illustrated in FIG. 2C.

FIG. 2C is a schematic, cross-sectional view of cover 121 of FIG. 2B after pressure is applied in a first direction as indicated by arrow 244 to shift cover 121 from the first position illustrated in FIG. 2B to a second position illustrated in FIG. 2C. In the embodiment of FIG. 2C, force applied by ball 202 landing on diverter seat 123 has shifted cover 121 further downhole, and has uncovered one or more ports including port 230, which were previously covered by cover 121 while cover 121 was in the first position. In some embodiments, where port 230 is a fracture port, ball 202 is pumped downhole to shift cover 121 before commencement of a fracturing operation. Similarly, where port 230 is a production port, ball 202 is pumped downhole to shift cover 121 before commencement of a production operation. It is understood that the number of ports illustrated in FIG. 2C is for illustration purposes, in some embodiments, a different number of ports are covered by cover 121 while cover 121 is in the first position illustrated in FIG. 2B.

In the embodiment of FIGS. 2B-2C, cover 121 has shifted from a location uphole of the tapered profile of flowbore 194 to a location downhole of the tapered profile of flowbore 194 that has a smaller circumference than the location uphole of the tapered profile, which collapses segments 126A and 126B behind ball 202. In the embodiment of FIG. 2C, protrusions 127A and 127B of collapsed segments 126A and 126B form a temporary diverter seat that restricts movement of ball 202 in an uphole direction. In some embodiments, the temporary diverter seat contains or is coated with a metal material or an elastomer to help retain ball 202, create a seal, and to reduce wear and tear of protrusions 127A and 127B. In some embodiments, segments 126A and 126B remain in the collapsed position until after completion of a well operation that utilizes port 230. In some embodiments, cover 121 is shifted back to the first position illustrated in FIG. 2E after completion of the well operation that utilizes port 230.

Figure 2D:
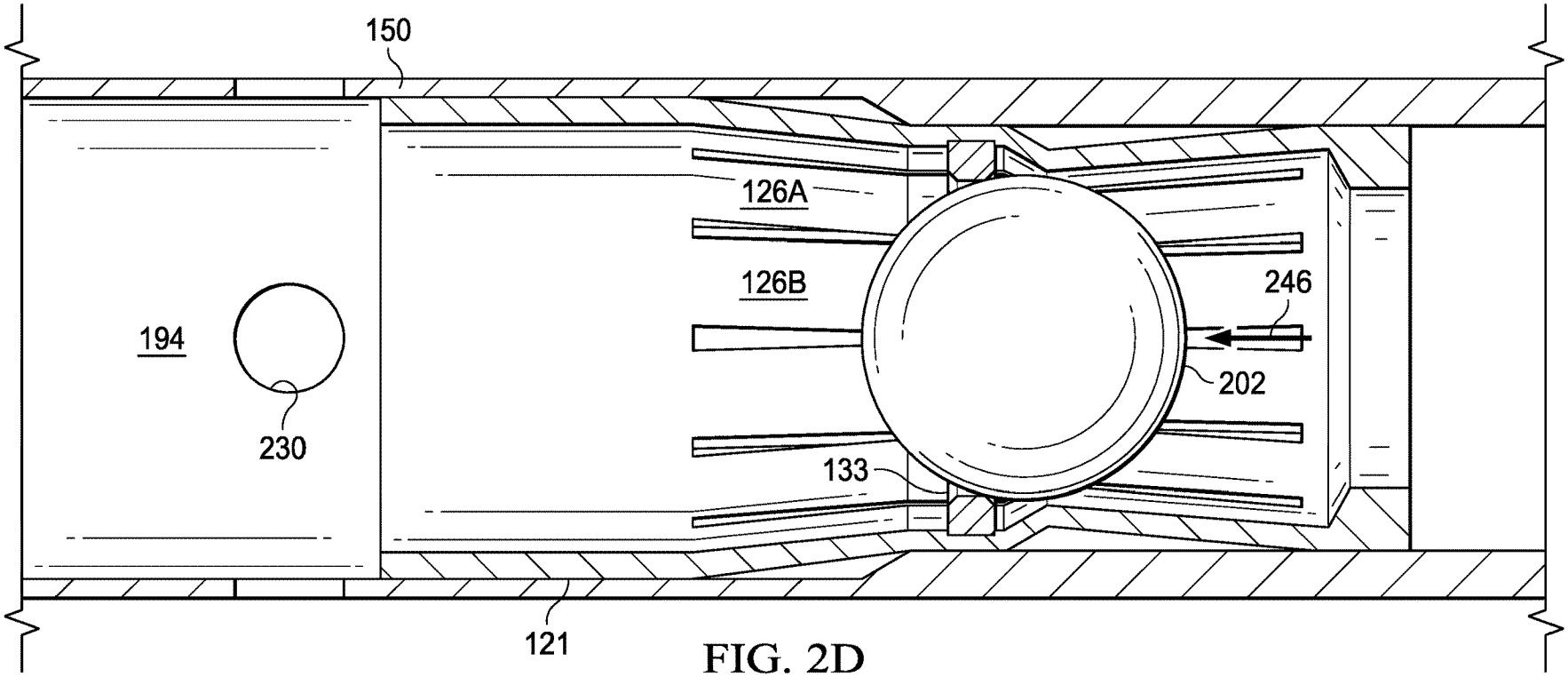
FIG. 2D illustrates a schematic, cross-sectional view of the cover of FIG. 2C after pressure is applied to the diverter in a second direction.

FIG. 2D illustrates a schematic, cross-sectional view of cover 121 of FIG. 2C after pressure is applied to ball 202 in a second direction, such as in an uphole direction as indicated by arrow 246. In the embodiment of FIG. 2D, ball 202 is retained by a temporary diverter seat 133, which is formed by protrusions 127A and 127B of collapsed segments 126A and 126B while segments 126A and 126B remain in the collapsed state. In the embodiment of FIG. 2D, cover 121 remains in the second position illustrated in FIGS. 2C and 2D until at least a threshold amount of pressure is applied to cover 121 and/or to ball 202 in an uphole direction, or in another direction. In one or more of such embodiments, cover 121 does not shift if pressure less than the threshold amount is applied to cover 121 or ball 202 to prevent premature release of ball 202, such as during a well operation that utilizes port 230. In some embodiments, the threshold amount of pressure to shift cover 121 from the second position to the first position is different from the threshold amount of pressure applied to shift cover 121 from the first position to the second position.

Figure 2E:
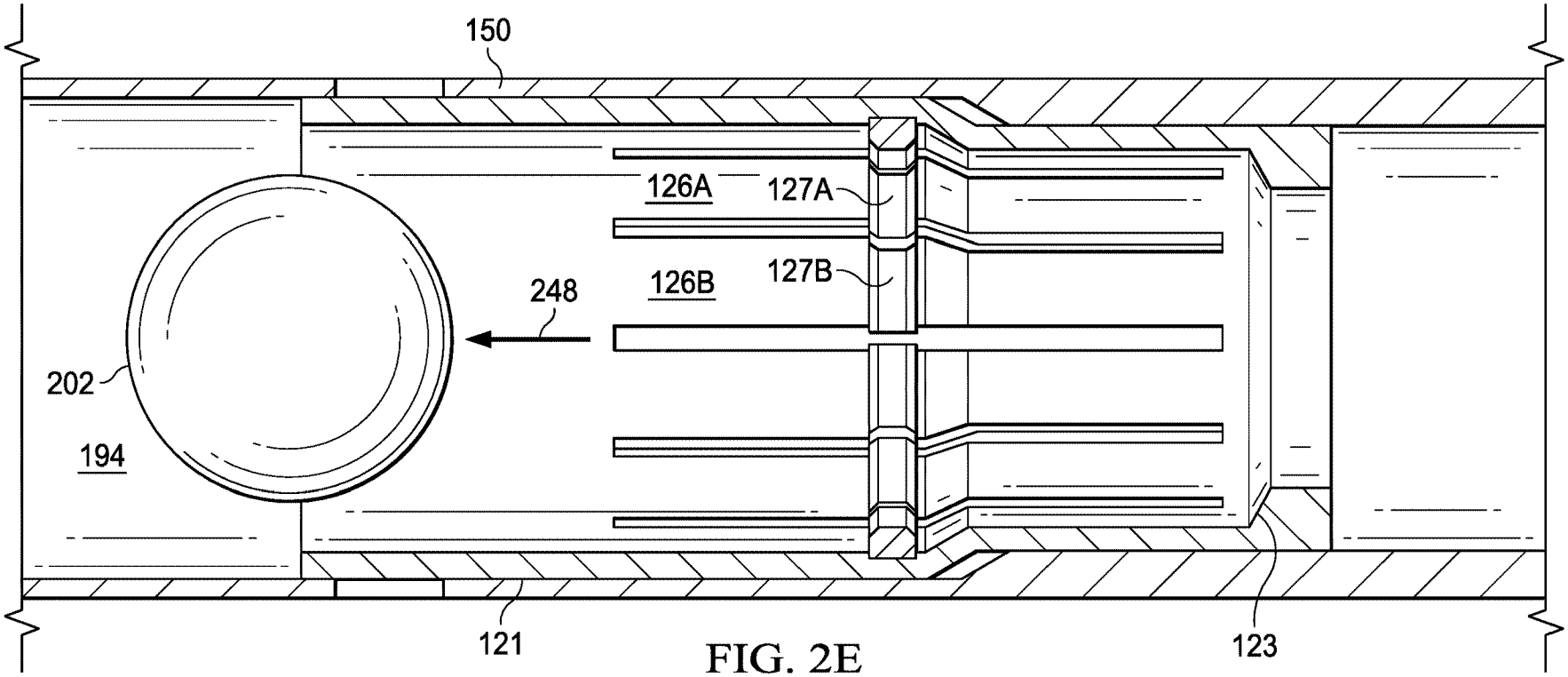
FIG. 2E illustrates a schematic cross-sectional view of the cover of FIG. 2D after a threshold amount of pressure is applied in the second direction to shift the cover from the second position to the first position.

FIG. 2E illustrates a schematic cross-sectional view of cover 121 of FIG. 2D after a threshold amount of pressure is applied in the second direction to shift cover 121 from the second position to the first position. In the embodiment of FIG. 2E, cover 121 has shifted back to the first position illustrated in FIG. 2A after the threshold amount of pressure is applied to cover 121 or ball 202 in an uphole direction.

As shown in FIGS. 2D-2E, segments 126A and 126B have un-collapsed and returned to a pre-collapsed shape that is similar or identical to the shape of segments 126A and 126B as illustrated in FIG. 2A. As shown in FIG. 2E, protrusions 127A and 127B of un-collapsed segments 126A and 126B no longer restrict movement of ball 202 in an uphole direction. Further, pressure is applied in the uphole direction as indicated by arrow 248 to reverse ball 202 out of the hollow interior, up flowbore 194 to the surface or another location uphole from cover 121. In some embodiments, pressure is applied to simultaneously shift cover 121 from the second position to the first position and to reverse ball 202 uphole.

In some embodiments, the foregoing operations described in the paragraphs above and illustrated in FIGS. 2A-2E are performed multiple times during different well operations. For example, where port 230 as illustrated in FIG. 2C is utilized multiple times during different well operations, a second ball or the same ball 202 is pumped downhole to shift cover 121 to the second position as illustrated in FIG. 2D during a well operation that utilizes port 230. After completion of the well operation that utilizes port 230, a threshold amount of pressure is applied in an uphole direction to shift cover 121 to the position illustrated in FIG. 2E. Further, although the foregoing paragraphs describe cover 121 as being deployed in completion system 118 of FIG. 1, cover 121 is deployable in any downhole environment, as a standalone apparatus, or as a component of another downhole apparatus or system. Further, although FIGS. 2B-2E illustrate deploying ball 202 to shift cover 121, in some embodiments, another type of diverter, such as a plug or a dart is utilized to shift cover 121.

In that regard, FIG. 3A is a schematic, partial cross-sectional view of another cover 321 disposed in tubular 150 of completion system 118 of FIG. 1. In the embodiment of FIG. 3A, cover 321 has a hollow interior that is configured to receive a diverter (such as a dart illustrated in FIG. 3B) through opening 322. A diverter seat 323 is formed from by or is disposed in the hollow interior of cover 321, and is configured to prevent the diverter from flowing further downhole. Cover 321 also has segments, including segments 326A and 326B, each having a protrusion, including protrusion 327A and protrusion 327B, and slits, including slits 325A and 325B that are positioned between adjacent segments. In some embodiments, segments 326A and 326B are fingers of a collet, and protrusions 327A and 327B are teeth or other profiles that engage the dart to restrict movement of the dart after the dart lands on diverter seat 323. It is understood that the number of segments, slits, and protrusions illustrated in FIG. 3A is for illustration purposes, in some embodiments, cover 321 has a different number of segments, slits, and protrusions that are circumferentially positioned around cover 321. Further, although FIG. 3A illustrates protrusions 327A and 327B as being inwardly protruding (towards the center of cover 321) and outwardly protruding (towards tubular 150) from segments 326A and 326B, in some embodiments, protrusions 327A and 327B are only outwardly protruding or only inwardly protruding. In the embodiment of FIG. 3A, tubular 150 has a recess 329 formed circumferentially along a wall of flowbore 194. Moreover, protrusions 327A and 327B are initially partially disposed within recess 329 to retain cover 321 in the initial position illustrated in FIG. 3A. In some embodiments, multiple recesses are formed around the wall of flowbore 194 to retain cover 321 in the initial position.

FIG. 3B is a schematic, partial cross-sectional view of cover 321 of FIG. 3A after a diverter flows into tubular 150. In the embodiment of FIG. 3B, a dart 302 flows in a direction illustrated by arrow 342 downhole towards diverter seat 323. In the embodiment of FIG. 3B, dart 302 has recess 328 that protrusions of cover 321 partially fit into. In that regard, FIG. 3C is a schematic, partial cross-sectional view of the cover of FIG. 3B, where profiles of dart 302 are aligned with profiles of cover 321 of FIG. 3B. As shown in FIG. 3C, recess 328 is configured to partially fit protrusions of cover 321. In the embodiment of FIG. 3C, force applied by dart 302 on diverter seat 323 when dart 302 lands on diverter seat 323 shifts cover 321 from the position illustrated in FIG. 3C to the position illustrated in FIG. 3D. In some embodiments, additional pressure is applied downhole (to dart 302 and/or cover 321) to shift cover 321 to the position illustrated in FIG. 3D. In one or more of such embodiments, where cover 321 shifts after a threshold amount of pressure is applied to cover 321, pressure is pumped downhole through flowbore 194 to shift cover 321 to the second position.

FIG. 3C' is a schematic, partial cross-sectional view of an alternative embodiment of the completion system illustrated in FIG. 3C where a retaining member 336 is disposed in tubular 150 and is held in a contracted position by cover 321 while cover 321 is in a first position as illustrated in FIGS. 3C and 3C'. As referred to herein, a retaining member is any member, device, or apparatus that prevents shifting of the cover from the first position to the second position or from the second position back to the first position. In the embodiment of FIG. 3C', retaining member 336 is a snap ring that is initially held in a retracted position by cover 321 while cover 321 is in the first position, and is configured to expand (as shown in FIG. 3D') after cover 321 shifts to a second position. Additional examples of retaining members include, but are not limited to, springs, expandable gauges, collets, burst discs, rupture discs, as well as other types of devices or members configured to prevent shifting of cover 321. Additional descriptions of retaining member 336 are provided herein.

FIG. 3C" is a schematic, partial cross sectional view of a second alternative embodiment of the completion system illustrated in FIG. 3C where a retaining member 337 is disposed in tubular 150 at a location further downhole relative to the location of retaining member 336 of FIG. 3C'. More particularly, retaining member 337 is positioned downhole of one or more ports that are initially covered by cover 321 while cover 321 is in the first position. In the embodiment of FIG. 3C", retaining member 337 is held in a contracted position by cover 321 while the cover 321 is in a first position.

FIG. 3C'" is a schematic, partial cross sectional view of a third alternative embodiment of the completion system illustrated in FIG. 3C where tubular 150 has a second recess 330 formed circumferentially along a wall of flowbore 194. In the embodiment of FIG. 3C'", second recess 330 is disposed further downhole from recess 329. Second recess 330, similar to recess 329, is also configured to partially fit protrusions of cover 321, thereby allowing cover 321 to shift to a third shiftable position. Additional descriptions of second recess 330 are provided herein and are illustrated in FIGS. 3D'" and 3E'". Further, retaining member 337 is positioned downhole of one or more ports that are initially covered by cover 321 while cover 321 is in the first position, and is held in a contracted position by cover 321 while cover 321 is in a first position.

FIG. 3D is a schematic, cross-sectional view of cover 321 of FIG. 3C after pressure is applied in a first direction as indicated by arrow 344 to shift cover 321 from the first position illustrated in FIG. 3C to a second position illustrated in FIG. 3D. In the embodiment of FIG. 3D, force applied by dart 302 landing on diverter seat 323 has shifted cover 321 further downhole, and has uncovered one or more ports including port 330, which was previously covered by cover 321 while cover 321 was in the first position. In some embodiments, where port 330 is a fracture port, dart 302 is pumped downhole to shift cover 321 before commencement of a fracturing operation. Similarly, where port 330 is a production port, dart 302 is pumped downhole to shift cover 321 before commencement of a production operation. It is understood that the number of ports illustrated in FIG. 3D are for illustration purposes, in some embodiments, a different number of ports are covered by cover 321 while cover 321 is in the first position illustrated in FIG. 3B.

In the embodiment of FIGS. 3C-3D, the segments of cover 321 have collapsed, which causes protrusions of cover 321 to lock into recess 328. Moreover, pressure applied by the protrusions onto dart 302 prevents dart 302 from moving in an uphole direction while the protrusions are locked into recess 328. In some embodiments, segments 326A and 326B remain in the collapsed position until after completion of a well operation that utilizes port 330. In some embodiments, cover 321 is shifted back to the first position illustrated in FIG. 3C after completion of the well operation that utilizes port 330.

In the embodiment of FIG. 3D, cover 321 remains in the second position illustrated in FIG. 3D until at least a threshold amount of pressure is applied to cover 321 or to dart 302 in an uphole direction, or in another direction. In one or more of such embodiments, cover 321 does not shift if pressure less than the threshold amount is applied to cover 321 or dart 302 to prevent premature release of dart 302, such as during a well operation that utilizes port 330. In some embodiments, the threshold amount of pressure to shift cover 321 from the second position to the first position is different from the threshold amount of pressure applied to shift cover 321 from the first position to the second position.

FIG. 3D' is a schematic, partial cross-sectional view of an alternative embodiment of the completion system illustrated in FIG. 3D where retaining member 336 shifts to an expanded position after cover 321 of FIG. 3C' shifts from the first position illustrated in FIG. 3C' to a second position illustrated in FIG. 3D'. In the embodiment of FIG. 3D', retaining member 336 has inwardly expanded to an expanded position. Moreover, while retaining member 336 is in the expanded position, retaining member 336 prevents cover 321 from shifting back to the first position as shown in FIG. 3C' to limit or prevent premature shifting of cover 321 back to the first position. In one or more of such embodiments, while retaining member 336 is in the expanded position, segments 326A and 326B remain in collapsed positions, and the protrusions remain locked into recess 328, thereby preventing a premature release of dart 302. In some embodiments, retaining member 336 is electrically actuated to expand after cover 321 shifts from the first position to the second position, and electronically actuated to retract after a threshold amount of pressure is applied by cover 321 to retaining member 336. In some embodiments, retaining member 336 is acoustically actuated to expand after cover 321 shifts from the first position to the second position, and acoustically actuated to retract after a threshold amount of pressure is applied by cover 321 to retaining member 336. In some embodiments, retaining member 336 is chemically actuated to expand after cover 321 shifts from the first position to the second position.

FIG. 3D" is a schematic, partial cross-sectional view of a second alternative embodiment of the completion system illustrated in FIG. 3D where retaining member 337 shifts to an expanded position after the cover of FIG. 3C" shifts from the first position illustrated in FIG. 3C" to a second position illustrated in FIG. 3D". Retaining element 337, similar to retaining element 336 of FIG. 3D', has inwardly expanded to an expanded position. Moreover, while retaining member 337 is in the expanded position, retaining member 337 prevents cover 321 from shifting back to the first position as shown in FIG. 3C' to limit or prevent premature shifting of cover 321 back to the first position. In the embodiment of FIG. 3D", where retaining element 337 is disposed downhole of port 330, expansion of retaining element 337 prevents cover 321 from prematurely covering port 330 during one or more well operations that utilize port 330.

FIG. 3D'" is a schematic, partial cross-sectional view of a third alternative embodiment of the completion system illustrated in FIG. 3D where cover 321 of FIG. 3C'" shifts from the first position illustrated in FIG. 3C'" to a second position illustrated in FIG. 3D'" that is further downhole from second recess 330. In the embodiment of FIG. 3D'", force applied by dart 302 landing on diverter seat 323 has shifted cover 321 further downhole, and has uncovered one or more ports including port 330, which was previously covered by cover 321 while cover 321 was in the first position. Further, retaining element 337, which is disposed downhole of port 330, has inwardly expanded to an expanded position, thereby preventing cover 321 from shifting back to the first position as shown in FIG. 3C". In the embodiment of FIGS. 3C" '-3D" ', the segments of cover 321 have collapsed, which causes protrusions of cover 321 to lock into recess 328. Moreover, the protrusions of the collapsed segments prevent dart 302 from moving in an uphole direction while the protrusions are locked into recess 328.

FIG. 3E illustrates a schematic cross-sectional view of cover 321 of FIG. 3D after a threshold amount of pressure is applied in a second direction to shift cover 321 from the second position to the first position. In the embodiment of FIG. 3E, cover 321 has shifted back to the first position illustrated in FIG. 3A after the threshold amount of pressure is applied to cover 321 or dart 302 in an uphole direction. As shown in FIGS. 3D-3E, segments 326A and 326B are configured to un-collapse and return to a pre-collapsed shape that is similar or identical to the shape of segments 326A and 326B as illustrated in FIG. 3A. As shown in FIG. 3E, protrusions of the un-collapsed segments 326A and 326B no longer restrict movement of dart 302 in an uphole direction. Further, pressure is applied in the uphole direction as indicated by arrow 346 to reverse dart 302 out of the hollow interior, up flowbore 194 to the surface or another location uphole from cover 321. In some embodiments, pressure is applied to simultaneously shift cover 321 from the second position to the first position and to reverse dart 302 uphole.

In some embodiments, the foregoing operations described in the paragraphs above and illustrated in FIGS. 3A-3E are performed multiple times during different well operations. For example, where port 330 as illustrated in FIG. 3C is utilized multiple times during different well operations, the same dart 302 or a second dart is pumped downhole to shift cover 321 to the second position as illustrated in FIG. 3D during a well operation that utilizes port 330. After completion of the well operation that utilizes port 330, a threshold amount of pressure is applied in an uphole direction to shift cover 321 to the position illustrated in FIG. 3E.

FIG. 3E' is a schematic, partial cross-sectional view of an alternative embodiment of the completion system illustrated in FIG. 3E where retaining member 336 prevents cover 321 from shifting from the second position illustrated in FIG. 3D' to the first position illustrated in FIG. 3C'. Moreover, segments of cover 321 are unable to return to the positions illustrated in FIG. 3C' and remain in collapsed positions. As such, protrusions remain locked into recess 328, thereby preventing a premature release of dart 302. In some embodiments, cover 321 is shiftable between the second position shown in FIG. 3D' and the location of retaining member 336 (third position) without returning to the first position shown in FIG. 3C' while retaining member 336 is in the expanded position. In one or more of such embodiments, cover 321 is configured to shuttle back and forth between the second position and the third position while retaining member 336 remains in the expanded position. In one or more of such embodiments, where multiple well operations are performed through port 330 or other ports that are initially covered by cover 321, a threshold amount of pressure is applied to cover 321 or dart 302 in an uphole direction after each well operation to shift cover 321 from the second position illustrated in FIG. 3D' to the third position illustrated in FIG. 3E' to cover the ports. Subsequently, a threshold amount of pressure is applied to cover 321 or dart 302 shift cover 321 in a downhole direction before commencement of the next well operation that utilizes one or more of the ports. In one or more of such embodiments, dart 302 remains locked in cover 321 while cover 321 shuttles back and forth between the second position and the third position. In some embodiments, retaining member 336 includes a shearable piece that shears in response to a threshold amount of pressure (such as the threshold amount of pressure to shift cover 321 from the second position to the first position). In one or more of such embodiments, retaining member 336 is shiftable from the expanded position to the contracted position after shearing of the shearable piece. In some embodiments, where retaining member 336 remains in the expanded position, or where segments of cover 321 remain collapsed, dart 302 is dissolvable, degradable, or melts over time. In one or more of such embodiments, dart 302 is configured to dissolve, degrade, or melt after a desired period of time to facilitate fluid flow through cover 321, or to facilitate subsequent well operations. In that regard, it is understood that in some embodiments, diverters described herein are configured to dissolve, degrade, or melt after a desired period of time.

FIG. 3E" is a schematic, partial cross-sectional view of a second alternative embodiment of the completion system illustrated in FIG. 3E where retaining member 337 prevents cover 321 from shifting from the position illustrated in FIG. 3D" to the first position illustrated in FIG. 3C". In the embodiment of FIG. 3E', cover 321 is shiftable between the second position shown in FIG. 3D" and the location of retaining member 337 (third position) without returning to the first position shown in FIG. 3C" while retaining member 337 is in the expanded position. Further, placement of retaining member 337 downhole from port 330 permits well operations that utilize port 330 to continue while retaining member 337 is in the expanded position. In that regard, retaining member 337 provides a mechanism to prevent premature closing of port 330 during a well operation that utilizes port 330. In some embodiments, retaining member 337 includes a shearable piece that shears in response to a threshold amount of pressure. In one or more of such embodiments, the threshold amount of pressure is applied to retaining member 337 after completion of a well operation that utilizes port 330. The applied pressure shears the shearable piece, thereby permitting cover 321 to shift to the first position and close port 330, and permitting dart 302 to reverse out of cover 321.

FIG. 3E'" is a schematic, partial cross-sectional view of a third alternative embodiment of the completion system illustrated in FIG. 3E where cover 321 shifts from the second position illustrated in FIG. 3D'" to a third position illustrated in FIG. 3E'". In the embodiment of FIG. 3E'", protrusions of cover 321 are partially disposed in second recess 330, thereby locking cover 321 in the third position. Further, the expanded retaining member 337 also prevents further uphole movement of cover 321. In some embodiments, retaining member 337 also forms a temporary diverter seat that prevents reversal of dart 302 out of cover 321 or to a location uphole of retaining member 337 while retaining member 337 is in the expanded position. In some embodiments, cover 321 is shiftable back and forth from the second position illustrated in FIG. 3D''' and the third position illustrated in FIG. 3E''' while retaining member 337 is in the expanded position. In some embodiments, where retaining member 337 has a shearable piece that is configured to shear in response to a threshold amount of pressure applied to the shearable piece, a threshold amount of pressure is applied to cover 321 or dart 302 to shear retaining member 337. Although FIGS. 3C'' '-3E'' ' illustrates two recesses 329 and 330, in some embodiments, additional recesses (not shown) are formed circumferentially along a wall of flowbore 194. In one or more of such embodiments, cover 321 is operable to shuttle back and forth between the first position illustrated in FIG. 3C''', the second position illustrated in FIG. 3D''', and additional positions where the protrusions of cover are locked into one of the additional recesses.

FIG. 4 is a flow chart of a process 400 to shift a downhole cover, such as cover 121 of FIGS. 1 and 2A-2E or cover 321 of FIGS. 3A-3E in two directions. Although the operations in the process 400 are shown in a particular sequence, certain operations may be performed in different sequences or at the same time where feasible.

At block S402, a diverter flows through a hollow interior of a cover. FIG. 2B, for example, illustrates flowing ball 202 through the hollow interior of cover 121. Further, FIG. 3B illustrates flowing dart 302 through the hollow interior of cover 321.

At block S404, the cover is shifted in a first direction from a first position to a second position. FIGS. 2B-2C, for example, illustrate shifting cover 121 in a downhole direction from the first position illustrated in FIG. 2B to a second position illustrated in FIG. 2C. Further, FIGS. 3C-3D illustrate shifting cover 321 from the first position illustrated in FIG. 3C to the second position illustrated in FIG. 3D.

At block S406, a plurality of segments are collapsed to retain the diverter. FIG. 2C, for example, illustrates collapsing segments 126A and 126B to form temporary diverter seat 133 behind ball 202 and to prevent movement of ball 202 in an uphole direction. Further, FIG. 3D illustrates collapsing segments 326A and 326B to lock protrusions of cover 321 into recess 328 of dart 302, thereby preventing movement of dart 302.

At block S408, after shifting the cover from the first position to the second position, a threshold amount pressure is applied to the diverter to shift the cover in a second direction from the second position to the first position. In that regard, FIGS. 2D-2E illustrate applying pressure in an uphole direction to shift cover 121 from the second position illustrated in FIG. 2D to the first position illustrated in FIG. 2E. Further, FIGS. 3D-3E illustrate applying pressure in an uphole direction to shift cover 321 from the second position illustrated in FIG. 3D to the first position illustrated in FIG. 3E.

At block S410, the plurality of segments are un-collapsed in response to shifting the cover from the second position towards the first position. In that regard, FIGS. 2D-2E also illustrate segments 126A and 126B returning to positions similar or identical to the positions of segments 126A and 126B as shown in FIG. 2A in response to cover 121 moving to the first position illustrated in FIG. 2A. Similarly, FIGS. 3D-3E illustrate segments 326A and 326B returning to positions similar or identical to the positions of segments 326A and 326B as shown in FIG. 3A in response to cover 321 moving to the first position illustrated in FIG. 3A. In some embodiments, the diverter (such as ball 202) of FIG. 2E is reversed out of the cover after the segments are un-collapsed.

In some embodiments, the foregoing operations described in blocks S402, S404, S406, S408, and S410 are performed multiple times during different well operations. For example, after un-collapsing the segments, the diverter is pumped out of the cover. A second diverter or the same diverter (such as ball 202 or dart 302) is then pumped into the hollow interior. The cover is then shifted in the first direction from the first position to the second position. The plurality of segments of the cover are collapsed to retain the second diverter during a well operation. After completion of the well operations, a threshold amount of pressure is applied to the second diverter to shift the cover in the second direction from the second position to the first position. The plurality of segments of the cover are then un-collapsed in response to shifting the cover from the second position towards the first position, and the second diverter is pumped out of the cover.

In some embodiments, the cover is further shiftable from the second position to a third position that is between the first position and the second position. In that regard, FIGS. 3D'-3E', FIGS. 3D''-3E'', and FIGS. 3D'''-3E''' each illustrate shifting cover 321 from the second position to a third position. In one or more of such embodiments, the cover is configured to shift back and forth between the second position and the third position during one or more well operations. For example, cover 321 of FIGS. 3D'-3E' is shiftable from the second position illustrated in FIG. 3D' to the third position illustrated in FIG. 3E' to cover port 330 after completion of each well operation that utilizes port 330, and is also shiftable from the third position illustrated in FIG. 3E' to the second position illustrated in FIG. 3D' to uncover port 330 before each subsequent well operation that utilizes port 330.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flow chart depicts a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, a shiftable cover, comprising: a hollow interior configured to receive a diverter flowing in a first direction; a diverter seat disposed in the hollow interior and configured to retain the diverter; and a plurality of segments configured to: collapse in response to shifting of the shiftable cover from a first position to a second position to retain the diverter; and un-collapse in response to shifting of the shiftable cover from the second position towards the first position.

Clause 2, the shiftable cover of clause 1, wherein the shiftable cover shifts from the second position towards the first position in response to a threshold amount of pressure applied to at least one of the shiftable cover and the diverter.

Clause 3, the shiftable cover of clause 2, wherein after the shiftable cover shifts from the first position to the second position, the plurality of segments prevent the diverter from flowing in a second direction out of the hollow interior.

Clause 4, the shiftable cover of clause 3, wherein after the shiftable cover shifts from the second position to the first position, the diverter is reversible in the second direction through the hollow interior.

Clause 5, the shiftable cover of any of clauses 1-4, wherein the plurality of segments form a temporary seat behind the diverter to retain the diverter while the shiftable cover is in the second position.

Clause 6, the shiftable cover of any of clauses 1-5, wherein at least one segment of the plurality of segments has a profile that engages a corresponding profile of the diverter while in a collapsed position.

Clause 7, the shiftable cover of any of clauses 1-6, wherein the plurality of segments form a collapsible collet that retains the diverter while in a collapsed position.

Clause 8, the shiftable cover of any of clauses 1-7, wherein the shiftable cover is a sliding sleeve that is shiftable from the first position to the second position and from the second position to the first position.

Clause 9, the shiftable cover of any of clauses 1-8, wherein the shiftable cover is shiftable from the second position to a third position.

Clause 10, the shiftable cover of clause 9, wherein the shiftable cover is shiftable back and forth between the second position and the third position.

Clause 11, the shiftable cover of clause 10, wherein a port is not covered by the shiftable cover while the shiftable cover is in the second position, and wherein the port is covered by the shiftable cover while the shiftable cover is in the third position.

Clause 12, shiftable cover of any of clauses 9-11, wherein the shiftable cover is shiftable from the third position to the first position, wherein the plurality of segments are configured to remain collapsed in response to shifting of the shiftable cover from the second position to the third position, and wherein the plurality of segments are configured to un-collapse in response to shifting of the shiftable cover from the third position to the first position.

Clause 13, a completion system, comprising: a port; and a shiftable cover comprising: a hollow interior configured to receive a diverter flowing in a first direction; a diverter seat disposed in the hollow interior and configured to retain the diverter; and a plurality of segments configured to: collapse in response to shifting of the shiftable cover from a first position to a second position to retain the diverter; and un-collapse in response to shifting of the shiftable cover from the second position towards the first position.

Clause 14, the completion system of clause 13, wherein the port is covered by the shiftable cover while the shiftable cover is in the first position, and wherein the port is uncovered by the shiftable cover while the shiftable cover is in the second position.

Clause 15, the completion system of clauses 13 or 14, further comprising a retaining member shiftable from a contracted position to an expanded position, wherein while the retaining member is in the expanded position, the retaining member prevents the shiftable cover from shifting to the first position.

Clause 16, the completion system of clause 15, wherein the retaining member is held in the contracted position by the shiftable cover while the shiftable cover is in the first position, and wherein the retaining member shifts from the contracted position to the expanded position after the shiftable cover shifts from the first position towards the second position.

Clause 17, the completion system of clause 16, wherein the retaining member comprises a shearable piece configured to shear in response to a threshold amount of pressure applied to the retaining member, and wherein the retaining member is shiftable from the expanded position to the contracted position after shearing of the shearable piece.

Clause 18, a method to shift a downhole cover in two different directions, the method comprising: flowing a diverter through a hollow interior of a cover, wherein a diverter seat disposed in the hollow interior is configured to retain the diverter; shifting the cover in a first direction from a first position to a second position; collapsing a plurality of segments to retain the diverter; after shifting the cover from the first position to the second position, applying a threshold amount pressure to the diverter to shift the cover in a second direction from the second position to the first position; and un-collapsing the plurality of segments in response to shifting the cover from the second position towards the first position.

Clause 19, the method of clause 18, further comprising: after un-collapsing the plurality of segments, flowing the diverter out of the cover; after flowing the diverter out of the cover, flowing a second diverter into the hollow interior; shifting the cover in the first direction from the first position to the second position; collapsing the plurality of segments to retain the second diverter; after shifting the downhole cover from the first position to the second position, applying the threshold amount pressure to the second diverter to shift the cover in the second direction from the second position to the first position; and un-collapsing the plurality of segments in response to shifting the cover from the second position towards the first position.

Clause 20, the method of any of clauses 18 or 19, further comprising: after un-collapsing the plurality of segments, flowing the diverter out of the cover; after flowing the diverter out of the cover, flowing the diverter back into the hollow interior; shifting the cover in the first direction from the first position to the second position; collapsing the plurality of segments to retain the diverter; after shifting the downhole cover from the first position to the second position, applying the threshold amount pressure to the diverter to shift the cover in the second direction from the second position to the first position; and un-collapsing the plurality of segments in response to shifting the cover from the second position towards the first position.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A shiftable cover, comprising:

a hollow interior configured to receive a diverter flowing in a first direction;

a diverter seat disposed in the hollow interior and configured to retain the diverter; and a plurality of segments configured to:

collapse in response to shifting of the shiftable cover from a first position to a second position to retain the diverter; and un-collapse in response to shifting of the shiftable cover from the second position towards the first position, wherein after the shiftable cover shifts from the first position to the second position, the plurality of segments prevent the diverter from flowing in a second direction uphole of the plurality of segments while the plurality of segments are collapsed.

2. The shiftable cover of claim 1, wherein the shiftable cover shifts from the second position towards the first position in response to a threshold amount of pressure applied to at least one of the shiftable cover and the diverter.

3. The shiftable cover of claim 2, wherein after the shiftable cover shifts from the first position to the second position, the plurality of segments prevent the diverter from flowing in the second direction out of the hollow interior.

4. The shiftable cover of claim 3, wherein after the shiftable cover shifts from the second position to the first position, the diverter is reversible in the second direction through the hollow interior.

5. The shiftable cover of claim 1, wherein the plurality of segments form a temporary seat behind the diverter to retain the diverter while the shiftable cover is in the second position.

6. The shiftable cover of claim 1, wherein at least one segment of the plurality of segments has a profile that engages a corresponding profile of the diverter while in a collapsed position.

7. The shiftable cover of claim 1, wherein the plurality of segments form a collapsible collet that retains the diverter while in a collapsed position.

8. The shiftable cover of claim 1, wherein the shiftable cover is a sliding sleeve that is shiftable from the first position to the second position and from the second position to the first position.

9. The shiftable cover of claim 1, wherein the shiftable cover is shiftable from the second position to a third position.

10. The shiftable cover of claim 9, wherein the shiftable cover is shiftable back and forth between the second position and the third position.

11. The shiftable cover of claim 10, wherein a port is not covered by the shiftable cover while the shiftable cover is in the second position, and wherein the port is covered by the shiftable cover while the shiftable cover is in the third position.

12. The shiftable cover of claim 9, wherein the shiftable cover is shiftable from the third position to the first position, wherein the plurality of segments are configured to remain collapsed in response to shifting of the shiftable cover from the second position to the third position, and wherein the plurality of segments are configured to un-collapse in response to shifting of the shiftable cover from the third position to the first position.

13. A completion system, comprising:

a port; and a shiftable cover comprising:

a hollow interior configured to receive a diverter flowing in a first direction;

a diverter seat disposed in the hollow interior and configured to retain the diverter; and a plurality of segments configured to:

collapse in response to shifting of the shiftable cover from a first position to a second position to retain the diverter; and un-collapse in response to shifting of the shiftable cover from the second position towards the first position, wherein after the shiftable cover shifts from the first position to the second position, the plurality of segments prevent the diverter from flowing in a second direction uphole of the plurality of segments while the plurality of segments are collapsed.

14. The completion system of claim 13, wherein the port is covered by the shiftable cover while the shiftable cover is in the first position, and wherein the port is uncovered by the shiftable cover while the shiftable cover is in the second position.

15. The completion system of claim 13, further comprising a retaining member shiftable from a contracted position to an expanded position, wherein while the retaining member is in the expanded position, the retaining member prevents the shiftable cover from shifting to the first position.

16. The completion system of claim 15, wherein the retaining member is held in the contracted position by the shiftable cover while the shiftable cover is in the first position, and wherein the retaining member shifts from the contracted position to the expanded position after the shiftable cover shifts from the first position towards the second position.

17. The completion system of claim 16, wherein the retaining member comprises a shearable piece configured to shear in response to a threshold amount of pressure applied to the retaining member, and wherein the retaining member is shiftable from the expanded position to the contracted position after shearing of the shearable piece.

18. A method to shift a downhole cover in two different directions, the method comprising:

flowing a diverter through a hollow interior of the cover, wherein a diverter seat disposed in the hollow interior is configured to retain the diverter;

shifting the cover in a first direction from a first position to a second position;

collapsing a plurality of segments to retain the diverter;

after shifting the cover from the first position to the second position, applying a threshold amount pressure to the diverter to shift the cover in a second direction from the second position to the first position; and un-collapsing the plurality of segments in response to shifting the cover from the second position towards the first position, wherein after the shiftable cover shifts from the first position to the second position, the plurality of segments prevent the diverter from flowing in the second direction uphole of the plurality of segments while the plurality of segments are collapsed.

19. The method of claim 18, further comprising:

after un-collapsing the plurality of segments, flowing the diverter out of the cover;

after flowing the diverter out of the cover, flowing a second diverter into the hollow interior;

shifting the cover in the first direction from the first position to the second position;

collapsing the plurality of segments to retain the second diverter;

after shifting the downhole cover from the first position to the second position, applying the threshold amount pressure to the second diverter to shift the cover in the second direction from the second position to the first position; and un-collapsing the plurality of segments in response to shifting the cover from the second position towards the first position.

20. The method of claim 18, further comprising:

after un-collapsing the plurality of segments, flowing the diverter out of the cover;

after flowing the diverter out of the cover, flowing the diverter back into the hollow interior;

shifting the cover in the first direction from the first position to the second position;

collapsing the plurality of segments to retain the diverter;

after shifting the downhole cover from the first position to the second position, applying the threshold amount pressure to the diverter to shift the cover in the second direction from the second position to the first position; and un-collapsing the plurality of segments in response to shifting the cover from the second position towards the first position.

* * * * *